US007459205B2

(12) United States Patent
Philp et al.

(10) Patent No.: US 7,459,205 B2
(45) Date of Patent: Dec. 2, 2008

(54) REINFORCING NET

(75) Inventors: Perry Philp, Barrie (CA); Roger Legg, Collingwood (CA); Sebastian Daniel, Richmond Hill (CA); Brian Gordon, Sunderland (CA)

(73) Assignee: Flexmaster Co. Ltd., Aurora, Ontario (CA)

( * ) Notice: Subject to any disclaimer, the term of this patent is extended or adjusted under 35 U.S.C. 154(b) by 306 days.

(21) Appl. No.: 10/654,956

(22) Filed: Sep. 5, 2003

(65) Prior Publication Data

US 2005/0054248 A1 Mar. 10, 2005

(51) Int. Cl.
*D04H 3/00* (2006.01)
*F16L 9/16* (2006.01)

(52) U.S. Cl. ..... 428/222; 428/221; 442/1; 442/50; 138/154

(58) Field of Classification Search ..... 442/2, 442/12, 14, 16, 1, 50; 428/221, 222, 105, 428/107–110; 138/154; 139/383 R–419
See application file for complete search history.

(56) References Cited

U.S. PATENT DOCUMENTS

| | | | | | |
|---|---|---|---|---|---|
| 3,360,410 | A | * | 12/1967 | Romanin | 156/172 |
| 3,459,621 | A | | 8/1969 | Kamenyarzh | |
| 3,526,565 | A | | 9/1970 | Walter | |
| 3,654,967 | A | * | 4/1972 | Atwell et al. | 138/144 |
| 4,080,232 | A | | 3/1978 | Friedrich | |
| 4,196,755 | A | | 4/1980 | Kutnuyak et al. | |
| 4,224,463 | A | | 9/1980 | Koerber et al. | |
| 4,308,895 | A | | 1/1982 | Greco | |
| 4,567,738 | A | | 2/1986 | Hutson et al. | |
| 4,870,535 | A | | 9/1989 | Matsumoto | |
| 5,338,593 | A | * | 8/1994 | Sasaki et al. | 428/110 |
| 5,526,849 | A | | 6/1996 | Gray | |
| 5,607,529 | A | | 3/1997 | Adamczyk et al. | |
| 5,785,091 | A | | 7/1998 | Barker | |
| 6,004,891 | A | * | 12/1999 | Tuppin et al. | 442/208 |
| 6,158,477 | A | * | 12/2000 | Waters | 138/129 |
| 2004/0185734 | A1 | * | 9/2004 | Gray et al. | 442/312 |

FOREIGN PATENT DOCUMENTS

| | | |
|---|---|---|
| DE | 1 087 559 | 8/1960 |
| EP | 0 425 099 A3 | 5/1991 |
| EP | 1 304 404 A1 | 4/2003 |
| WO | WO 92/08831 | 5/1992 |

* cited by examiner

*Primary Examiner*—Arti R. Singh
*Assistant Examiner*—Matthew D Matzek
(74) *Attorney, Agent, or Firm*—Bereskin & Parr

(57) ABSTRACT

A reinforcing net for use in a reinforcing layer is formed by spacing two parallel spreader yarns under tension and wrapping weft yarns around the two spreader yarns. The reinforcing net can either be affixed to an adhesive coated substrate or coated with adhesive at the intersections of the yarns to bond the net together. The net may be affixed to a plurality of substrates to form a laminate. The net, a ribbon of net with one substrate, and the laminate, may be used in making and reinforcing spirally wound products such as ducts, duct insulation and the like. A number of warp yarns can be included in the reinforcing net to increase its strength. The method of manufacturing the reinforcing net includes the steps of creating tension in the spreader yarns, providing a least one spool for supplying weft yarn, longitudinally advancing the spreader yarns, rotating the spool around the advancing spreader yarns and applying adhesive to the intersections of the yarns.

22 Claims, 25 Drawing Sheets

50

150

250

350

150a

250a

350a

350b

80

180

280

380

80a

180a

280a

380a

80b

180b

280b

380b

REINFORCING NET

FIELD OF THE INVENTION

This invention relates to conduits, and in particular, to a reinforcing net which may be affixed to a substrate, for forming a helically wound conduit.

BACKGROUND OF THE INVENTION

Helically wound conduits are used to transfer fluid in many different applications. These conduits may be constructed by helically winding a flexible strip material to form a helically wound conduit. During their use and installation, these conduits are subjected to various forces and internal pressures. It is desirable that the conduit be able to withstand these various forces and internal pressures. Presently, a reinforcing layer, commonly called scrim, is often used to strengthen conduits. This scrim is usually constructed by layering or weaving a number of crisscrossing yarns; coating these yarns in an adhesive to form a large sheet; and then cutting the scrim in desired widths from the large sheet. This method of making scrim is complex, time-consuming and inefficient.

Accordingly, there is a need for a reinforcing net, used in forming a helically wound conduit, that is easier and more efficient to manufacture and can be manufactured in various widths without additional preparation.

SUMMARY OF THE INVENTION

One embodiment of the invention is directed to a reinforcing net for use in making a product. This reinforcing net comprises: at least two separated, substantially parallel continuous longitudinally extending spreader yarns, which define a longitudinally extending plane; a plurality of continuous weft yarns; and, an adhesive. The weft yarns extend at an angle to the spreader yarns. These weft yarns extend across one side of the plane around one of the spreader yarns and across the plane on the other side of the plane to the other spreader yarn and around the other spreader yarn.

Another embodiment of the invention is directed to a ribbon for use in helical winding to make a product. The ribbon comprises: at least one substrate having a width and a longitudinal axis; an adhesive on the substrate; and a reinforcing net. The reinforcing net is affixed to the substrate and comprises: at least two, separated, substantially parallel, continuous, longitudinally extending spreader yarns; a plurality of continuous weft yarns; and an adhesive. The spreader yarns define a longitudinally extending plane. The weft yarns extend at an angle to the spreader yarns. These weft yarns extend across one side of the plane around one of the spreader yarns and across the plane on the other side of the plane to the other spreader yarn and around the other spreader yarn.

Another embodiment of the invention is directed to a ribbon that consists of a least two substrates to form a laminate for use in helical winding to make a product. The ribbon comprises: at least a first substrate and a second substrate, each substrate having a width and a longitudinal axis; an adhesive on the substrate; and a reinforcing net. The reinforcing net is affixed between the first and second substrates and comprises: at least two separated, substantially parallel, continuous, longitudinally extending spreader yarns, which define a longitudinally extending plane; a plurality of continuous weft yarns; and, an adhesive. The weft yarns extend at an angle to the spreader yarns. These weft yarns extend across one side of the plane around one of the spreader yarns and across the plane on the other side of the plane to the other spreader yarn and around the other spreader yarn.

This invention is also directed to a method of manufacturing a reinforcing net, a ribbon or a laminate. The method involves: creating tension in at least two separated, substantially parallel, continuous, longitudinally extending spreader yarns, these spreader yarns defining a first longitudinally extending plane; providing at least one spool, this spool supplying a weft yarn; causing the spreader yarns to longitudinally advance away from the spool; rotating the at least one spool in a second plane substantially perpendicular to the first plane whereby the weft yarn helically winds around the spreader yarns causing the weft yarn to extend at an angle to the spreader yarns and extend across one side of the first plane around one of the spreader yarns and across the plane on the other side to the other spreader yarn and around the other spreader yarn; and applying an adhesive to at least the spreader yarns where the spreader yarns and the weft yarn intersect.

BRIEF DESCRIPTION OF THE DRAWINGS

For a better understanding of the present invention and to show clearly how it may be carried into effect, reference will now be made, by way of example, to the accompanying drawings which show embodiments of the present invention and in which.

DETAILED DESCRIPTION OF THE INVENTION

Figure 1:
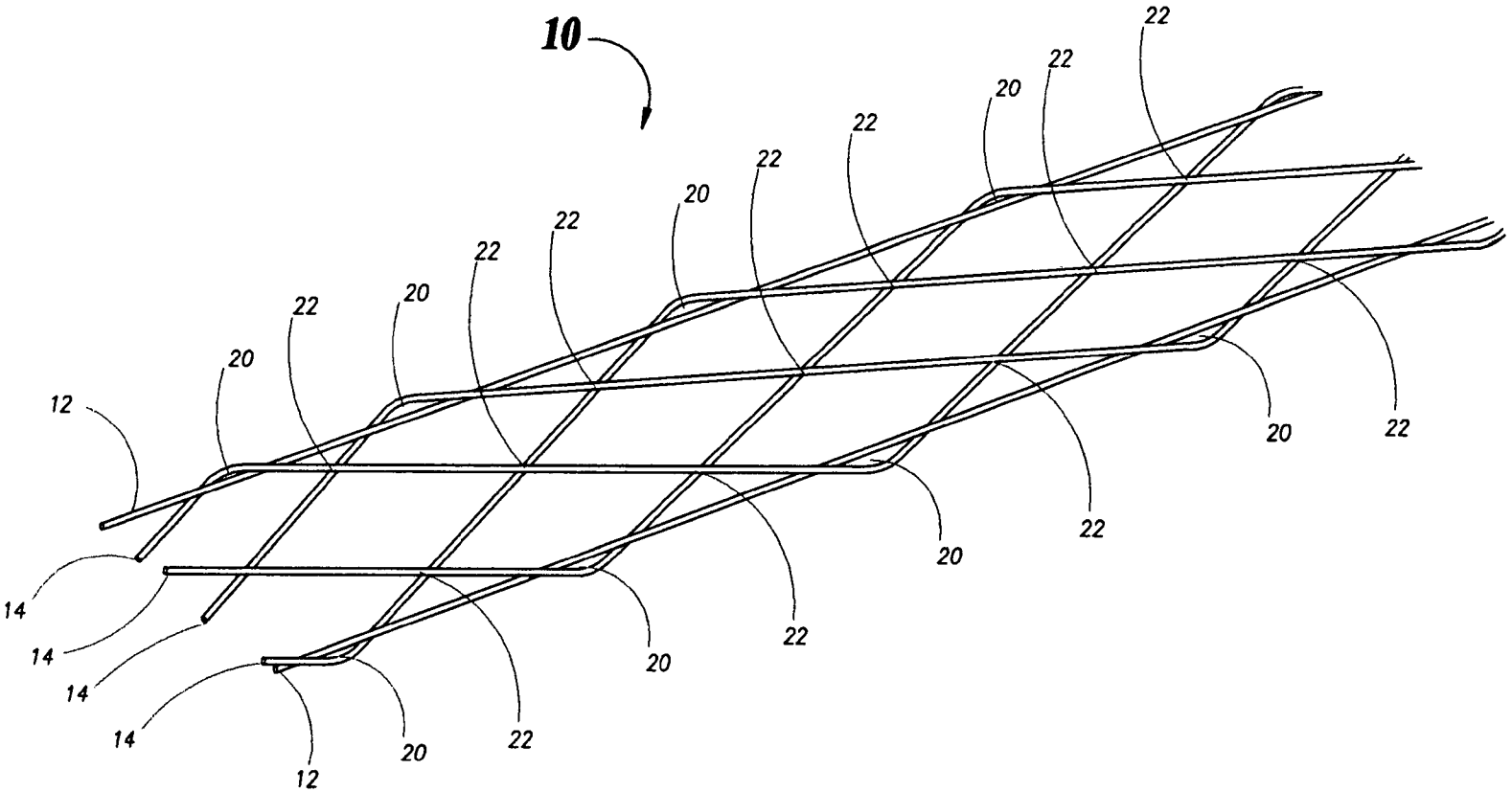
FIG. 1 is a perspective view of a first embodiment of the invention, a reinforcing net made in accordance with the subject invention.

Referring to FIG. 1, illustrated therein is a reinforcing net 10 shown generally in accordance with a first embodiment of the invention. Reinforcing net 10 is a reinforcing layer used in a helical winding to make a product. Reinforcing net 10 comprises at least two spreader yarns 12, at least one weft yarn 14 and an adhesive.

Reinforcing net 10 is constructed having at least two spreader yarns 12. These two separated spreader yarns 12 are substantially parallel and extend longitudinally. The spreader yarns form a longitudinally extending plane. A plurality of continuous weft yarns 14 are wrapped around the spreader yarns 12. The weft yarns 14 extend at an angle from the spreader yarns 12, across one side of the plane to one of the spreader yarns 12, wrap around the spreader yarn 12 and extend across the plane on the other side of the plane back to the other spreader yarn 12 and around the other spreader yarn 12. The weft yarns 14 continue this pattern, forming the weft of the reinforcing net 10. Weft yarns 14 and spreader yarns 12 can be any suitable material including: fiberglass, cotton, polyamide, polyester, wire, synthetic or natural fibers.

Referring again to FIG. 1, while the adhesive can be located everywhere on reinforcing net 10, there are a number of locations where it may be preferable to have adhesive. Where the weft yarns 14 wrap around the spreader yarns 12, a plurality of first intersections 20 are formed. Adhesive can be located at these first intersections 20 to bond a spreader yarn 12 to a weft yarn 14 at each intersection 20. The weft yarns 14 will also cross each other forming a plurality of second intersections 22. Adhesive can be located at some or all of these second intersections 22 to bond two weft yarns 14 to each other at these second intersections 22.

Figure 2:
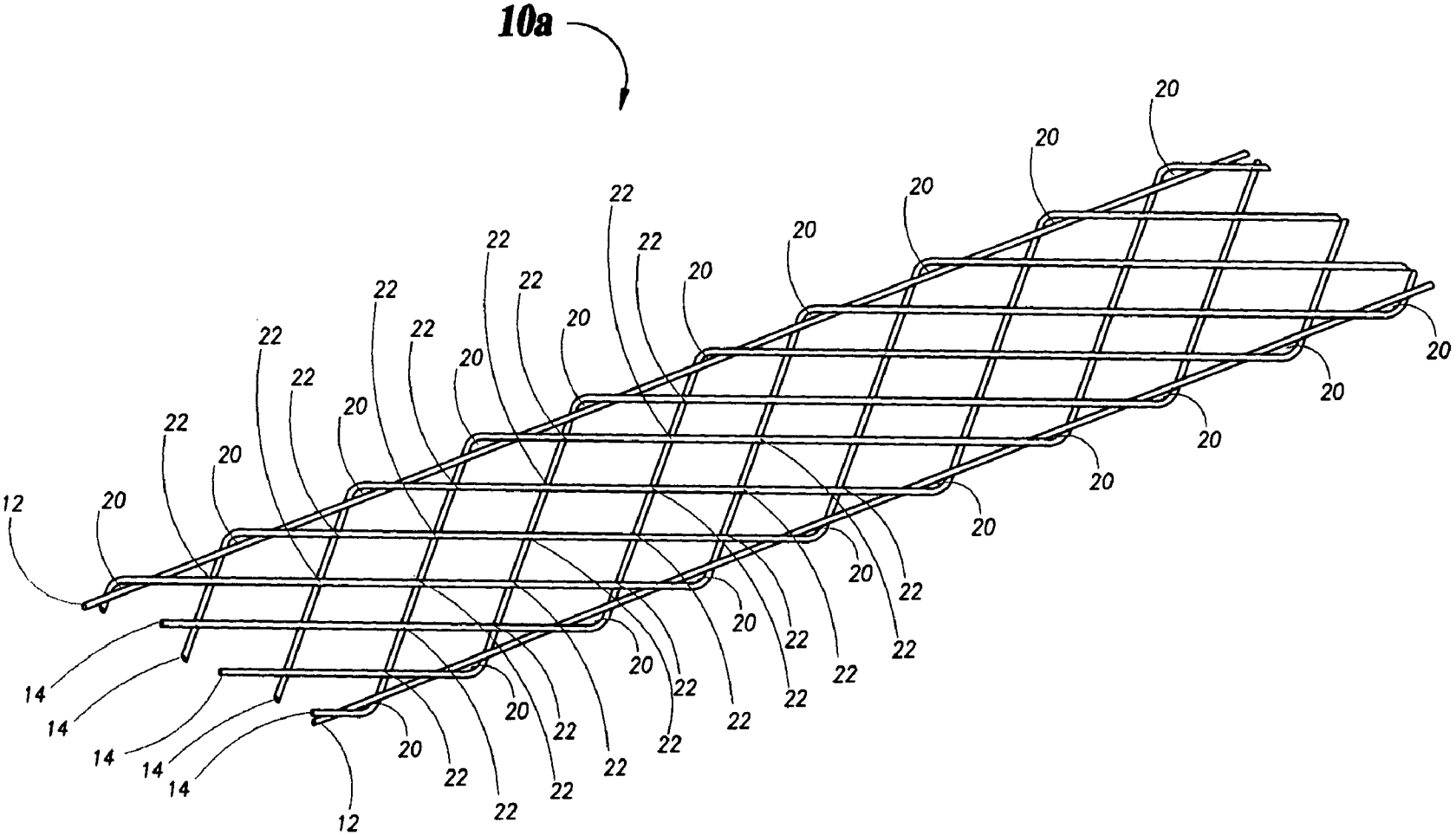
FIG. 2 is a perspective view of a variation of the first embodiment of the invention, a reinforcing net made in accordance with the subject invention.

When two weft yarns 14 or a multiple of two weft yarns 14 are used in the reinforcing net 10, a diamond pattern can be produced. This diamond pattern can be varied as a result of varying the number of weft yarns used in the reinforcing net 10 and by varying the angles at which the weft yarns 14 extend from the spreader yarns 12. In FIG. 1 there are four weft yarns 14. FIG. 2 illustrates a variation of reinforcing net 10*a* using six weft yarns, extending at a greater angle from each spreader yarn 12 than the reinforcing net 10 illustrated in FIG. 1 and as a result, a tighter diamond pattern is formed, which has more intersections 22 over a given longitudinal length.

Figure 3:
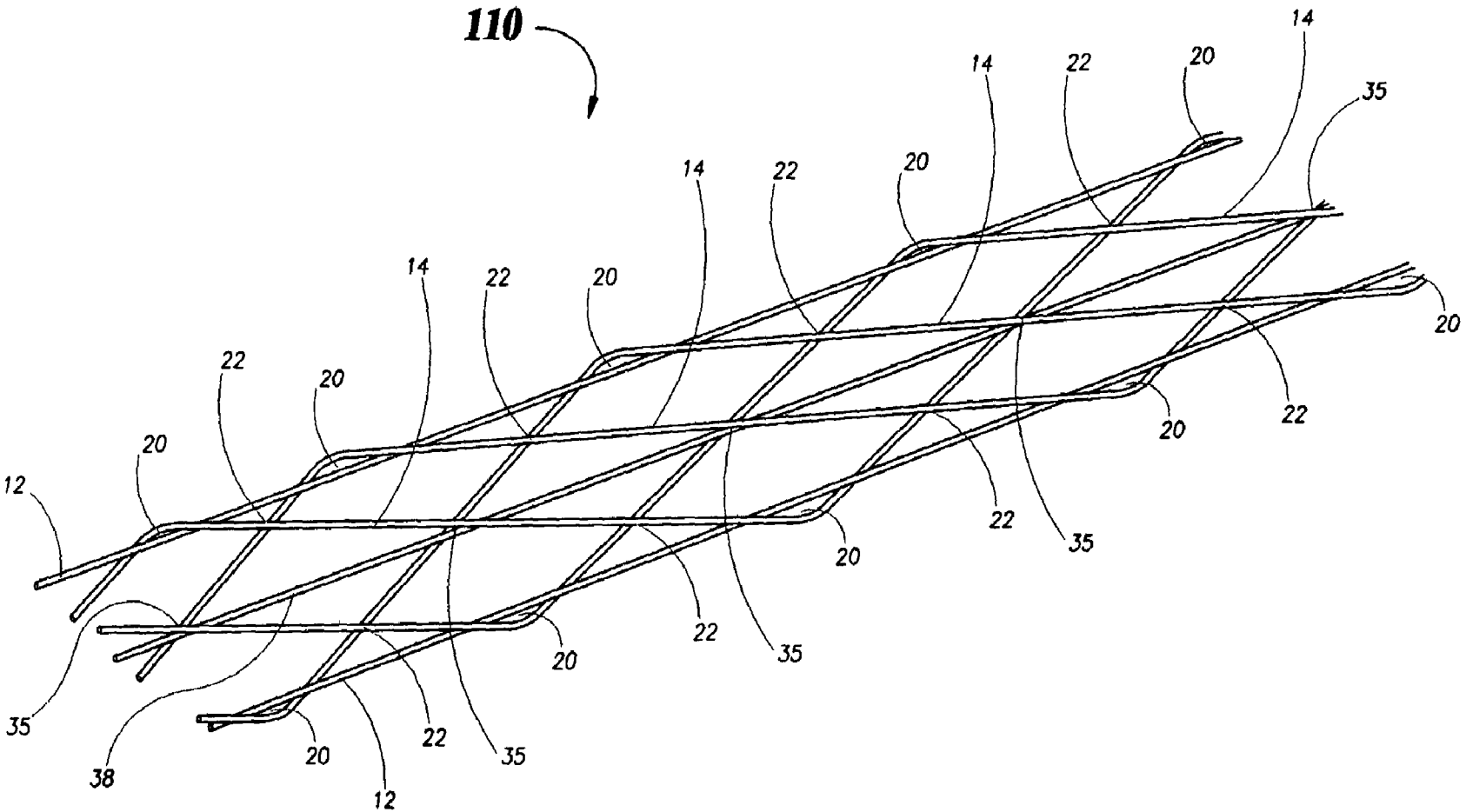
FIG. 3 is a perspective view of a second aspect of the first embodiment of the invention, a reinforcing net which comprises a warp yarn, made in accordance with the subject invention.

Referring to FIG. 3, illustrated therein is another aspect of the first embodiment of the invention, reinforcing net 110. Reinforcing net 110 comprises all of the elements of reinforcing net 10 or 10*a*, but also comprises at least one warp yarn 38. Elements common to both reinforcing net 10 and 110 are indicated with the same number.

Warp yarn 38 is substantially parallel to the spreader yarns 12 and extends longitudinally between the two spreader yarns 12. The weft yarns 14 extend at an angle to the spreader yarns 12 across one side of the plane over warp yarn 38 to one of the spreader yarns 12, wrap around the spreader yarn 12 and extend back across the plane on the other side of the plane under warp yarn 38 to the other spreader yarn 12 and around the other spreader yarn 12. The weft yarns 14 continue this pattern to form the weft in reinforcing net 110.

Similar to the embodiment of reinforcing net 10 shown in FIG. 1, the weft yarns 14 cross the spreader yarns 12 and form a plurality of first intersections 20 and cross each other to form a plurality of second intersections 22. Adhesive can be located at these first intersections 20 and some or all of second intersections 22 to bond the reinforcing net 110 together. Because of the inclusion of warp yarn 38 in reinforcing net 110, individual weft yarns 14 will cross warp yarn 38 to form a plurality of third intersections 35. Desirably, adhesive can also be located at these third intersections 35 to bond weft yarns 14 to warp yarn 38 and thereby add to the strength of the net. Third intersections 35 may or may not coincide with one or more second intersections 22 depending on the location of the warp yarn 38.

Figure 3A:
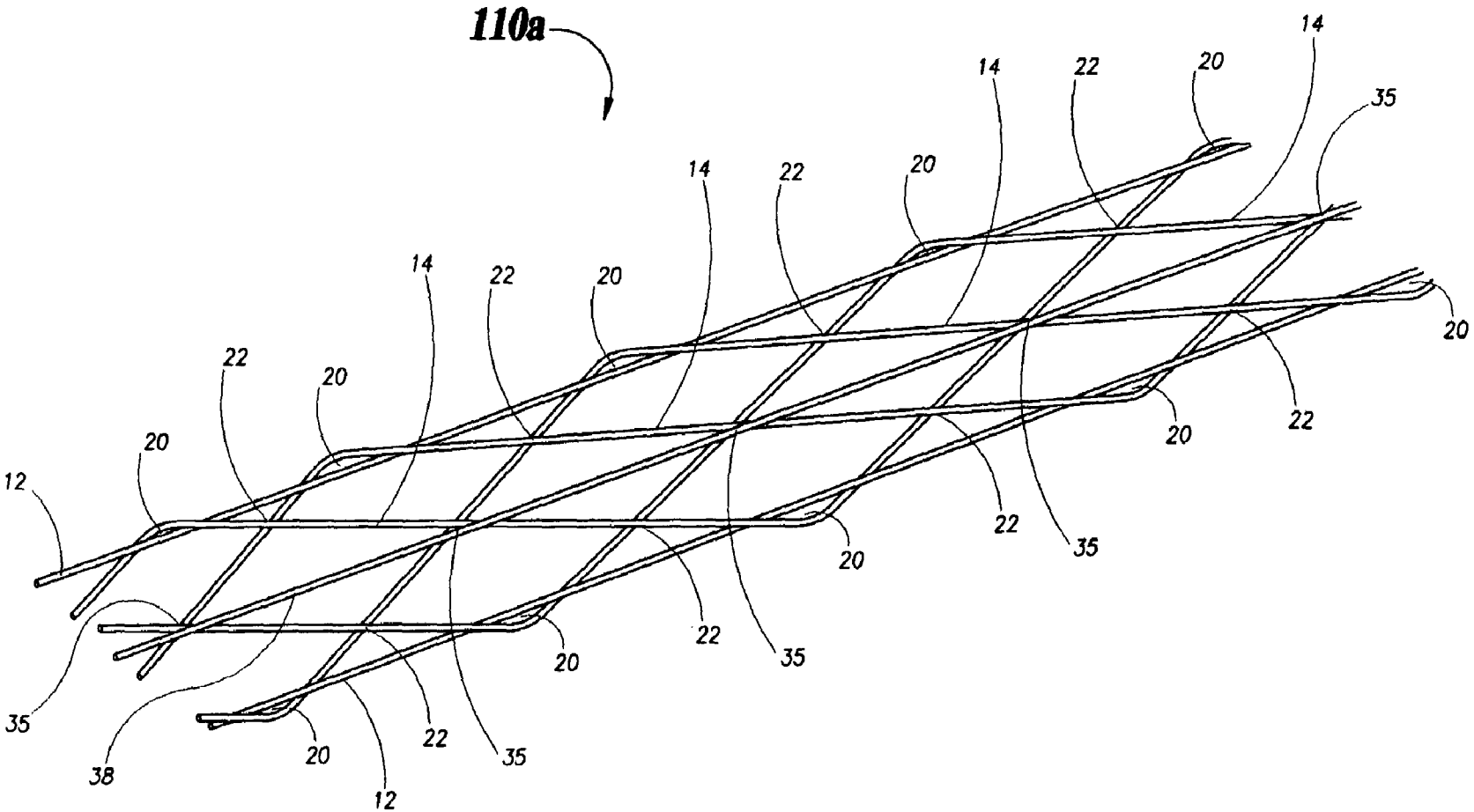
FIG. 3*a* is a perspective view of a third aspect of the first embodiment of the invention, a reinforcing net which comprises a warp yarn located adjacent to the weft yarns made in accordance with the subject invention.

Referring to FIG. 3*a*, illustrated therein is another aspect of the first embodiment of the invention, reinforcing net 110*a*. Reinforcing net 110*a* is similar to reinforcing net 110 in that it comprises all of the same elements, however, warp yarn 38, is located adjacent to weft yarns 14, rather than between weft yarns 14 as in reinforcing net 110.

Figure 4:
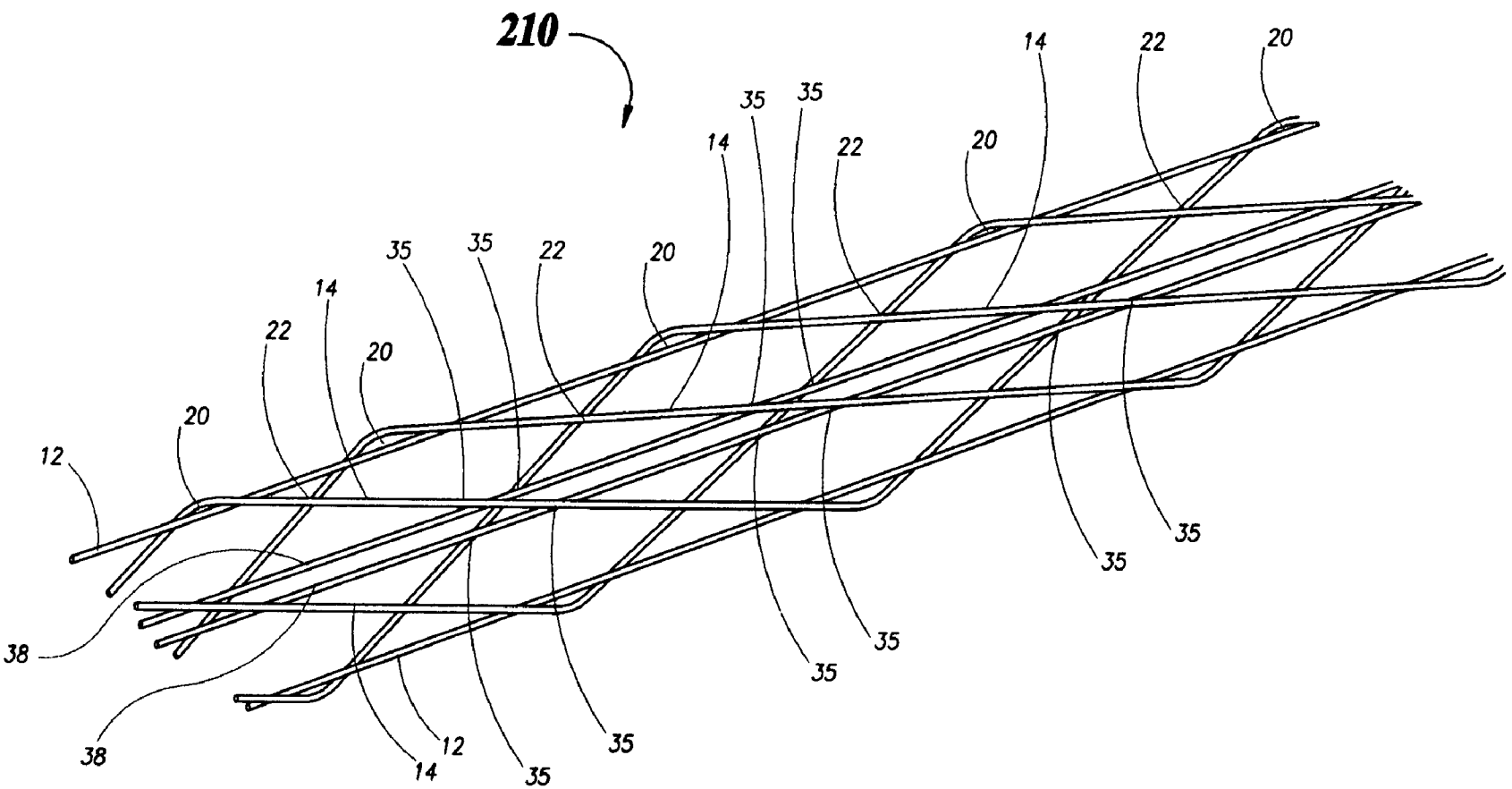
FIG. 4 is a perspective view of a fourth aspect of the first embodiment of the invention, a reinforcing net which comprises two warp yarns made in accordance with the subject invention.

Referring to FIG. 4, illustrated therein is another aspect of the first embodiment of the invention, reinforcing net 210. Reinforcing net 210 is similar to reinforcing net 110 in that it comprises all of the same elements, however, reinforcing net 210 comprises two warp yarns 38. This in turn means there are twice as many third intersections 35 between a weft yarn 14 and a warp yarn 38 as compared to FIG. 3.

Figure 4A:
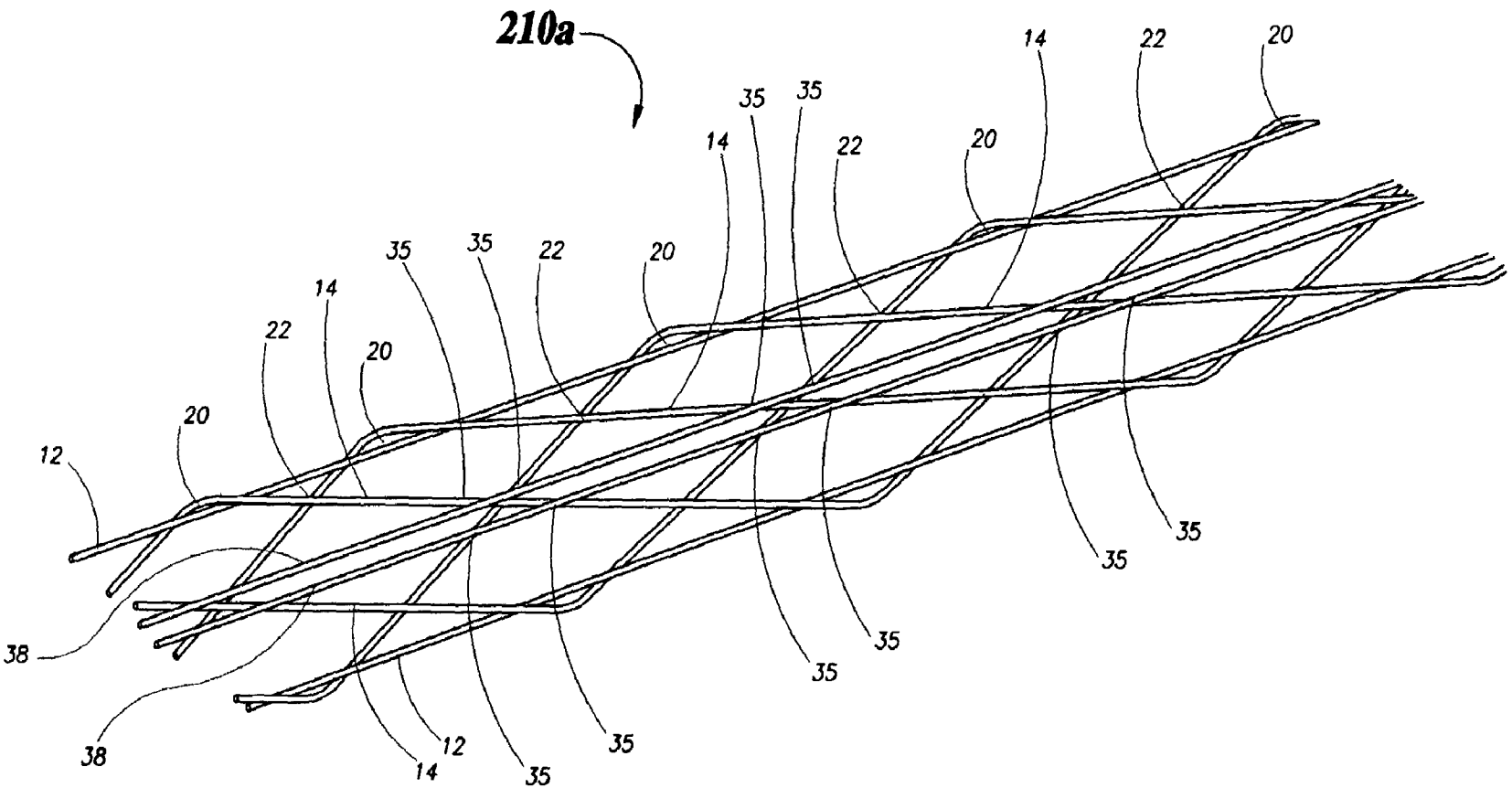
FIG. 4*a* is a perspective view of a fifth aspect of the first embodiment of the invention, a reinforcing net which comprises two warp yarns located adjacent to the weft yarns made in accordance with the subject invention.

Referring to FIG. 4*a*, illustrated therein is another aspect of the first embodiment of the invention, reinforcing net 210*a*. Reinforcing net 210*a* is similar to reinforcing net 210 in that it comprises all of the same elements, however, the two warp yarns 38, are located adjacent to weft yarns 14 on the same side of the plane, rather than between the weft yarns 14, as in reinforcing net 210.

Figure 4B:
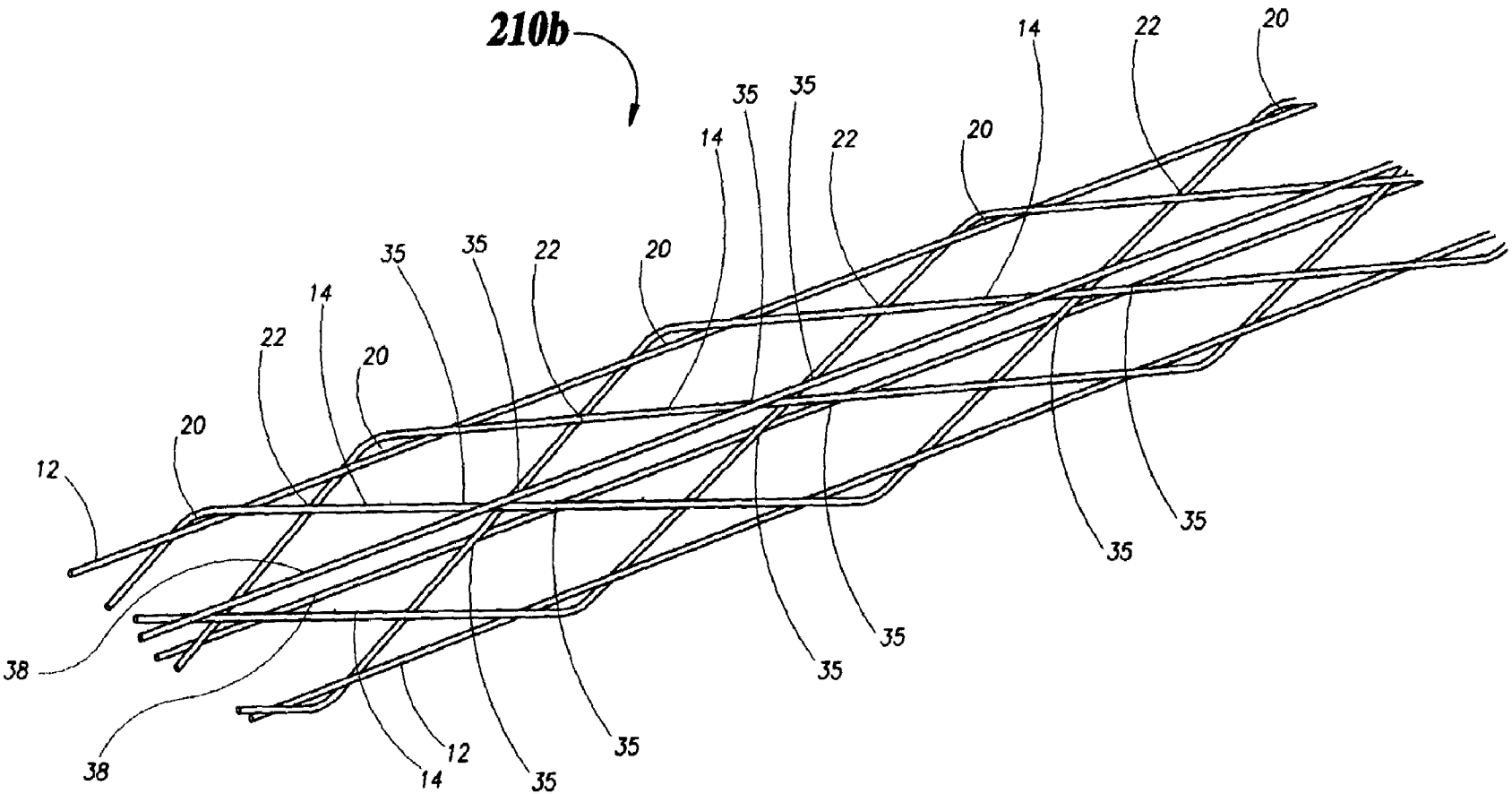
FIG. 4*b* is a perspective view of a sixth aspect of the first embodiment of the invention, a reinforcing net which comprises two warp yarns located adjacent to the weft yarns one on one side of the plane and the other on the other side of the plane and made in accordance with the subject invention.

Referring to FIG. 4*b*, illustrated therein is another aspect of the first embodiment of the invention, reinforcing net 210*b*. Reinforcing net 210*b* is similar to reinforcing net 210*a* in that it comprises all of the same elements, however, one of the warp yarns 38 is located adjacent to weft yarns 14 on one side of the plane, and the other warp yarn 38 is located adjacent to the weft yarns 14 on the other side of the plane.

Figure 5:
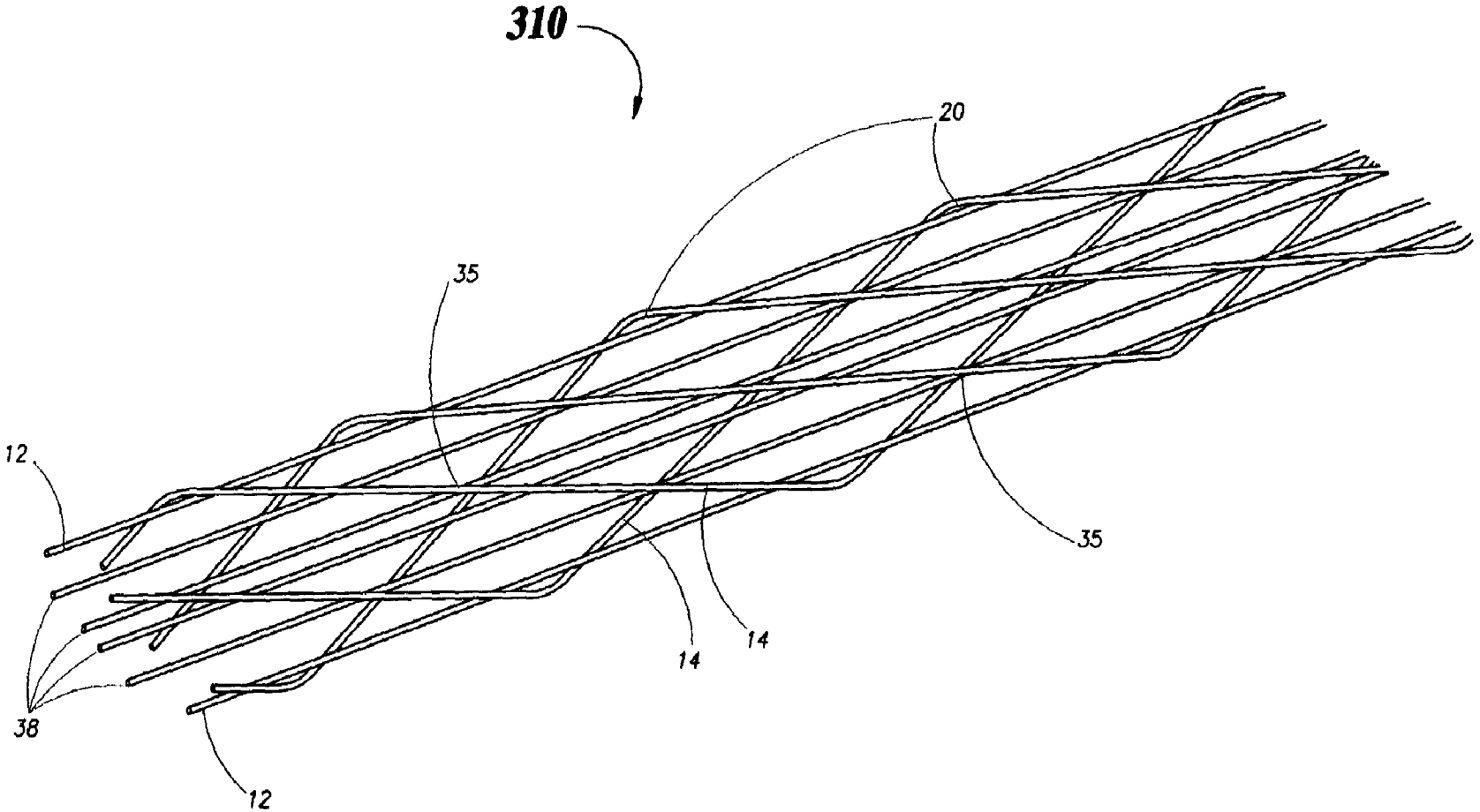
FIG. 5 is a perspective view of a seventh aspect of the first embodiment of the invention, a reinforcing net which comprises four warp yarns, made in accordance with the subject invention.

Referring to FIG. 5, illustrated therein is another aspect of the first embodiment of the invention, reinforcing net 310. Reinforcing net 310 is similar to reinforcing nets 110 and 210, except that it comprises four warp yarns 38, located between weft yarns 14 and which provide even more third intersections 35.

Figure 5A:
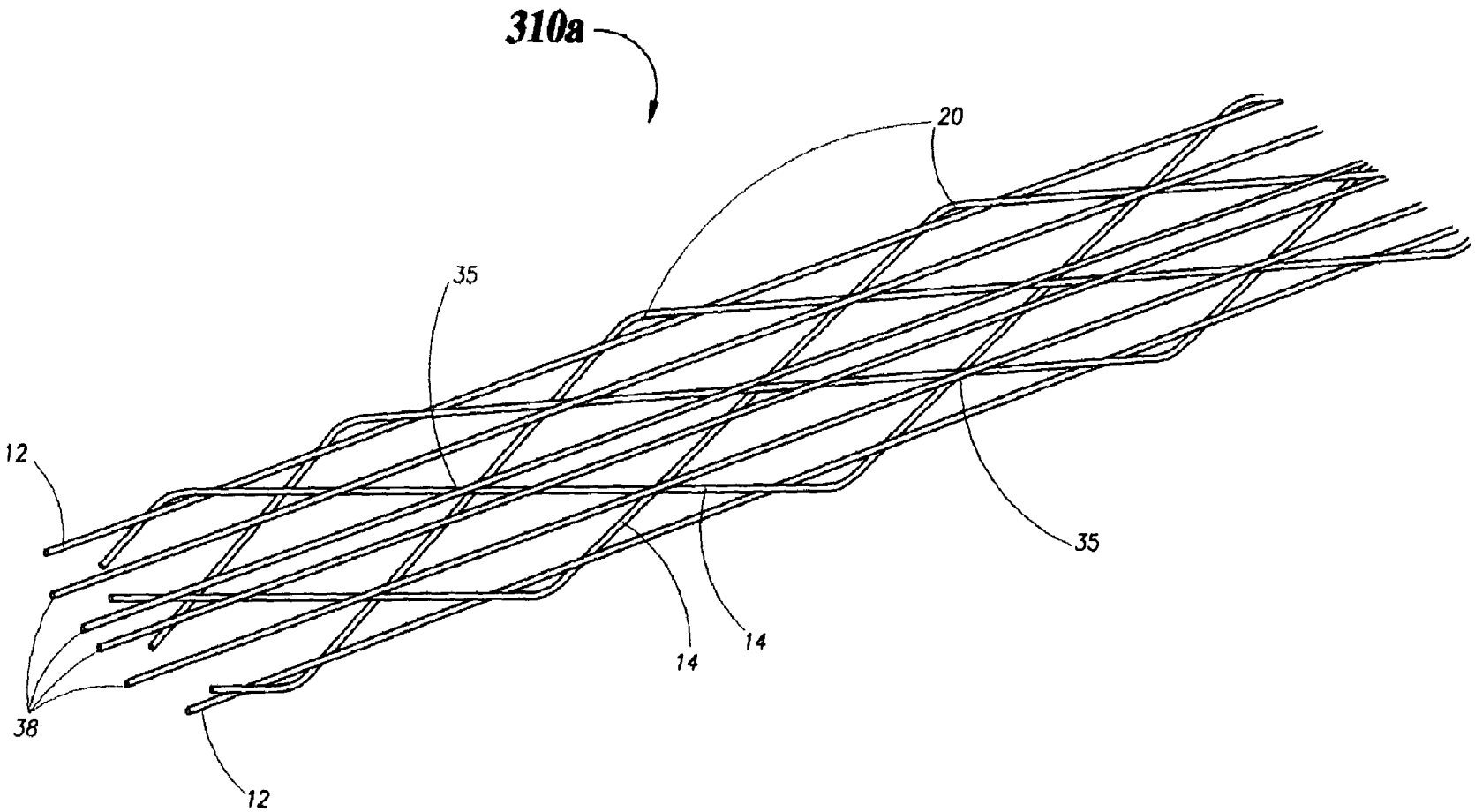
FIG. 5*a* is a perspective view of a eighth aspect of the first embodiment of the invention, a reinforcing net which comprises four warp yarns located adjacent to the weft yarns made in accordance with the subject invention.

Referring to FIG. 5*a*, illustrated therein is another aspect of the first embodiment of the invention, reinforcing net 310*a*. Reinforcing net 310*a* is similar to reinforcing net 310, except that the four warp yarns 38, which provide even more third intersections 35, are located adjacent to the weft yarns 14 on the same side of the plane.

Figure 5B:
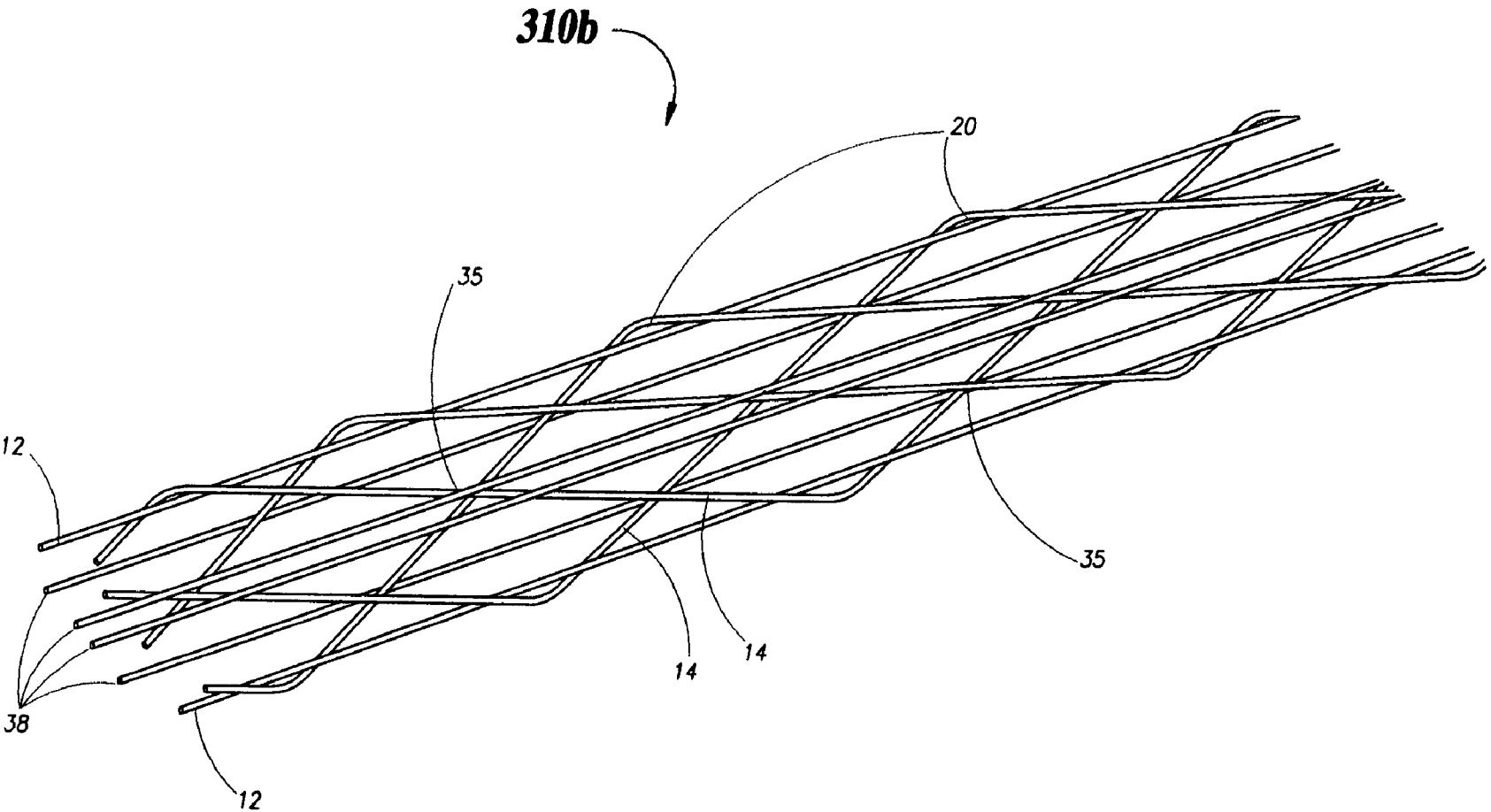
FIG. 5*b* is a perspective view of a ninth aspect of the first embodiment of the invention, a reinforcing net which comprises four warp yarns, two warps yarns located adjacent to the weft yarns on one side of the plane and the other two warp yarns located adjacent to the weft yarns on the other side of the plane, made in accordance with the subject invention.

Referring to FIG. 5*b*, illustrated therein is another aspect of the first embodiment of the invention, reinforcing net 310*b*. Reinforcing net 310*b* is similar to reinforcing net 310*a*, except that two of the four warp yarns 38 are adjacent to the weft yarns 14 on one side of the plane and the other two warp yarns are adjacent to the weft yarns 14 on the other side of the plane.

Figure 6:
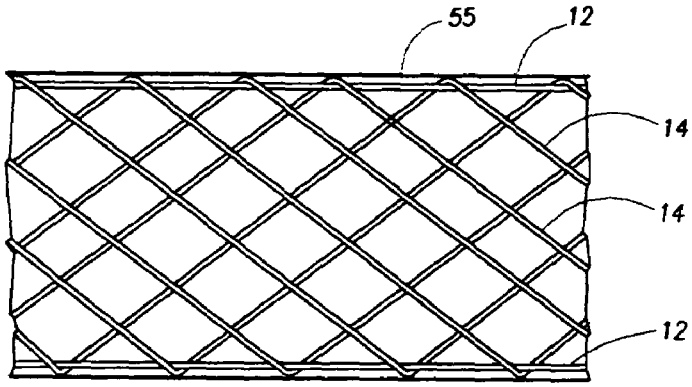
FIG. 6 is a top view of a second embodiment of the invention, a ribbon made in accordance with the subject invention.

Referring to FIG. 6, illustrated therein is a second embodiment of the invention, ribbon 50. Ribbon 50 is a reinforcing component, which may be used in a helical winding to make a product and is a combination of a first substrate 55, an adhesive on said first substrate 55 and reinforcing net 10.

The first substrate 55 may be made of a thermoplastic material, but can be made from any suitable material. On the surface of the first substrate 55 is an adhesive. The reinforcing net 10 is affixed to the first substrate 55 by means of the adhesive.

Additionally, a reinforcing wire 69 can be incorporated into ribbon 50 to add structural rigidity and support in the final product as discussed in more detail below.

Figure 7:
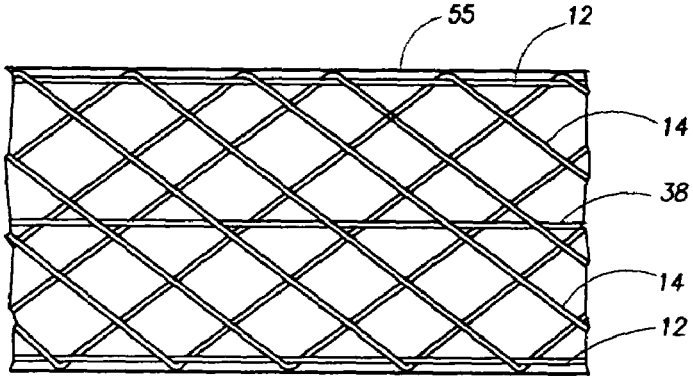
FIG. 7 is a top view of a second aspect of the second embodiment of the invention, a ribbon, which comprises a warp yarn, made in accordance with the subject invention.

Referring to FIG. 7, illustrated therein is a second aspect of the second embodiment of the invention, ribbon 150. Ribbon 150 is a reinforcing component, which may be used in a helical winding to make a product and is a combination of a first substrate 55, an adhesive on said first substrate 55 and reinforcing net 110. Reinforcing net 110 is affixed to the first substrate 55 by the adhesive.

Figure 7A:
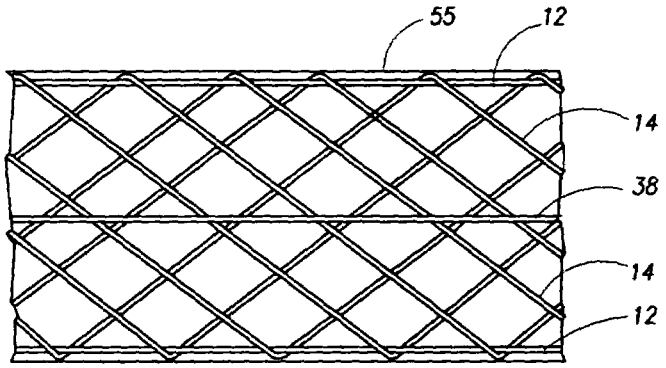
FIG. 7*a* is a top view of a third aspect of the second embodiment of the invention, a ribbon which comprises a warp yarn located adjacent to the weft yarns made in accordance with the subject invention.

Referring to FIG. 7*a*, illustrated therein is a third aspect of the second embodiment of the invention, ribbon 150*a*. Ribbon 150*a* is a reinforcing component, which may be used in a helical winding to make a product and is a combination of first substrate 55 and reinforcing net 110*a* affixed to the first substrate 55 by the adhesive.

Figure 8:
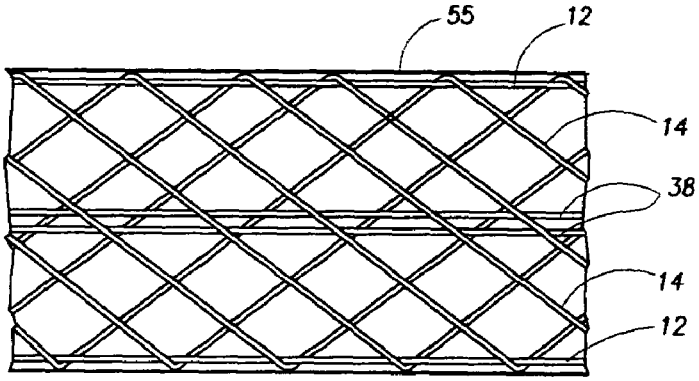
FIG. 8 is a top view of a fourth aspect of the second embodiment of the invention, a ribbon which comprises two warp yarns, made in accordance with the subject invention.

Referring to FIG. 8, illustrated therein is a fourth aspect of the second embodiment of the invention, ribbon 250. Ribbon 250 is a reinforcing component, which may be used in a helical winding to make a product and is a combination of first substrate 55 and reinforcing net 210 affixed to the first substrate 55 by the adhesive.

Figure 8A:
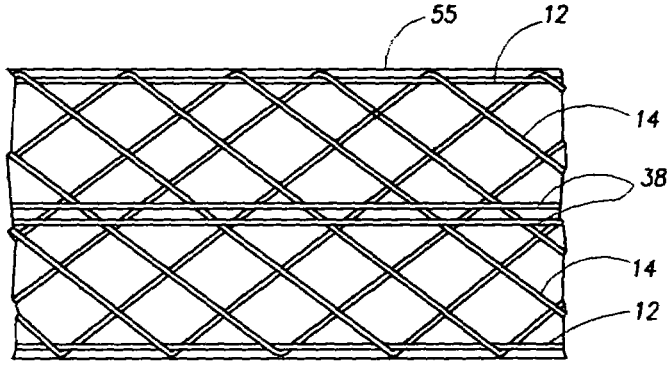
FIG. 8*a* is a top view of a fifth aspect of the second embodiment of the invention, a ribbon which comprises two warp yarns located adjacent to the weft yarns made in accordance with the subject invention.

Referring to FIG. 8*a*, illustrated therein is a fifth aspect of the second embodiment of the invention, ribbon 250*a*. Ribbon 250*a* is a reinforcing component, which may be used in a helical winding to make a product and is a combination of first substrate 55 and reinforcing net 210*a* affixed to the first substrate 55 by the adhesive.

Figure 9:
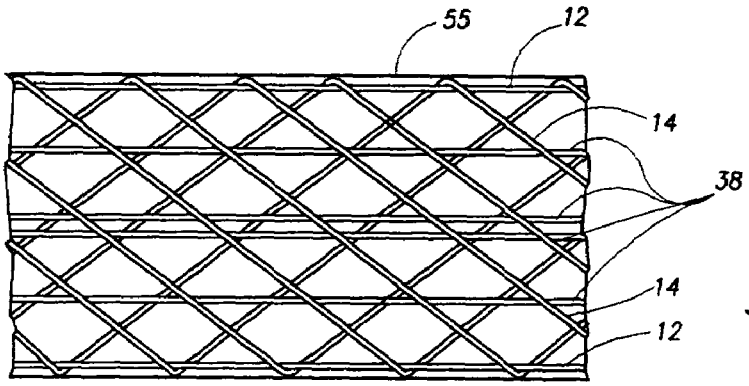
FIG. 9 is a top view of a sixth aspect of the second embodiment of the invention, a ribbon which comprises four warp yarns made in accordance with the subject invention.

Referring to FIG. 9, illustrated therein is a sixth aspect of the second embodiment of the invention, ribbon 350. Ribbon 350 is a reinforcing component, which is used in a helical winding to make a product and is a combination of a first substrate 55, an adhesive on said first substrate 55 and reinforcing net 310.

Figure 9A:
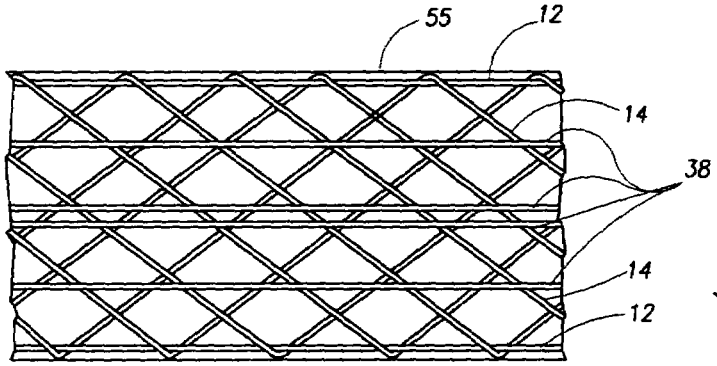
FIG. 9*a* is a top view of a seventh aspect of the second embodiment of the invention, a ribbon which comprises four warp yarns located adjacent to the exterior of the weft yarns made in accordance with the subject invention.

Referring to FIG. 9*a*, illustrated therein is a seventh aspect of the second embodiment of the invention, ribbon 350*a*. Ribbon 350*a* is a reinforcing component, which is used in a helical winding to make a product and is a combination of a first substrate 55, an adhesive on said first substrate 55 and reinforcing net 310*a*.

Figure 9B:
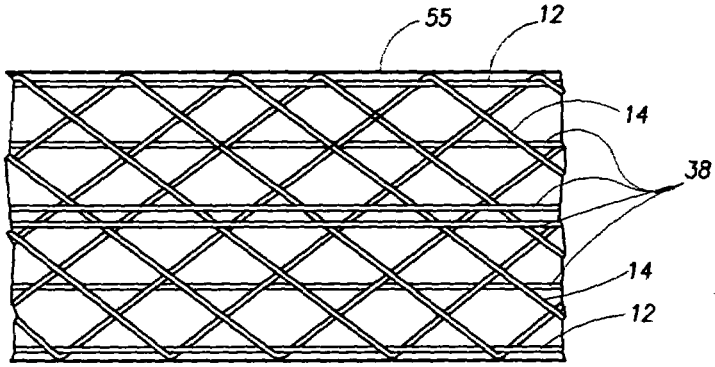
FIG. 9*b* is a top view of a eighth aspect of the second embodiment of the invention, a ribbon which comprises four warps yarns, two warps yarns adjacent to the weft yarns on one side of the plane and the other two warp yarns adjacent to the weft yarns on the other side of the plane made in accordance with the subject invention.

Referring to FIG. 9*b*, illustrated therein is a eighth aspect of the second embodiment of the invention, ribbon 350*b*. Ribbon 350*b* is a reinforcing component, which is used in a helical winding to make a product and is a combination of a first substrate 55, an adhesive on said first substrate 55 and reinforcing net 310*b*.

In each case the width of the ribbon 50, 150, 250 or 350 is slightly, preferably although not necessarily, greater than the spacing between the spreader yarns 12 of the respective nets 10, 110, 210 and 310, and the spreader yarns 12 extend substantially parallel to the longitudinal edges of the substrate 55.

Figure 10:
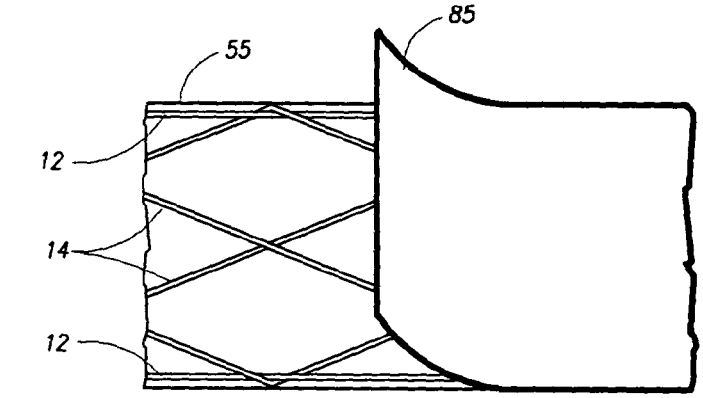
FIG. 10 is a top view of a third embodiment of the invention, a ribbon that comprises at least two substrates forming a laminate, made in accordance with the subject invention.

Referring to FIG. 10, illustrated therein is a laminate 80, a third embodiment of the invention. Laminate 80 may be used in a helical winding to make or reinforce a product. Laminate 80 is a type of ribbon that is a combination of a first substrate 55, reinforcing net 10, a second substrate 85 and adhesive. Reinforcing net 10 is sandwiched between first substrate 55 and second substrate 85. The adhesive is located on first substrate 55, second substrate 85 or both first substrate 55 and second substrate 85 and affixes first substrate 55, reinforcing net 10 and second substrate 85 together to form a reinforced laminate 80.

Figure 10A:
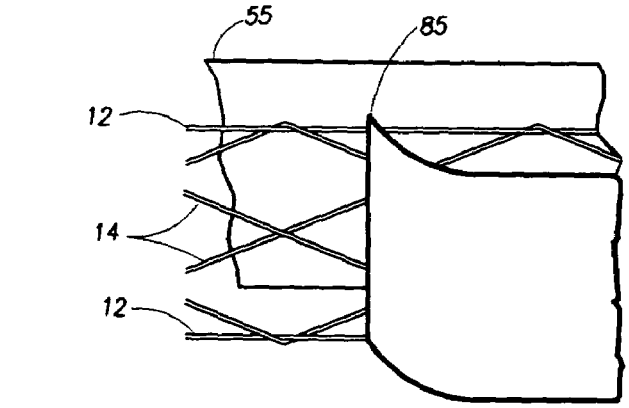
FIG. 10*a* is a top view of a second aspect of the third embodiment of the invention, a laminate, having the first substrate offset from the second substrate made in accordance with the subject invention.

Referring to FIG. 10*a*, illustrated therein is a laminate 80*a*, a second aspect of the third embodiment of the invention. Laminate 80*a* is similar to laminate 80, in that it comprises all of the same elements, except that first substrate 55 and second substrate 85 are offset latterly from each other. The offset edges may be advantageous when the laminate is spirally wound to make a product.

Figure 10B:
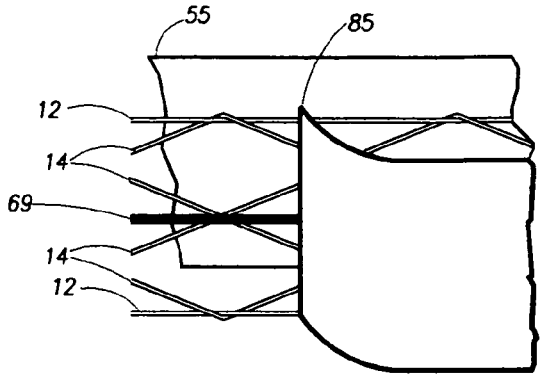
FIG. 10*b* is a top view of a third aspect of a third embodiment of the invention, a laminate having the first substrate offset from the second substrate and further comprising a reinforcing wire made in accordance with the subject invention.

Referring to FIG. 10*b*, illustrated therein is a laminate 80*b*, a third aspect of the third embodiment of the invention. Laminate 80*b* is similar to laminate 80*a*, except that it also comprises a reinforcing wire 69. Reinforcing wire 69 is incorporated into laminate 80*a* between the first substrate 55 and second substrate 85 adjacent to the reinforcing net 10 and adds structural strength and rigidity.

Figure 11:
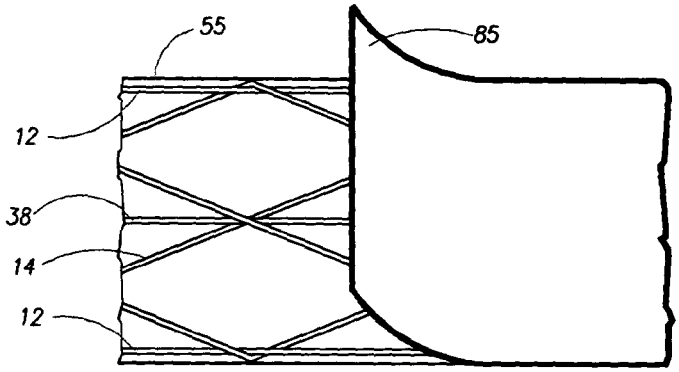
FIG. 11 is a top view of a third aspect of the third embodiment, a laminate which comprises a warp yarn made in accordance with the subject invention.

Referring to FIG. 11, illustrated therein is a laminate 180, a fourth aspect of the third embodiment of the invention. Laminate 180 may be used in a helical winding to make or reinforce a product and is a combination of first substrate 55, reinforcing net 110, second substrate 85 and adhesive.

Figure 11A:
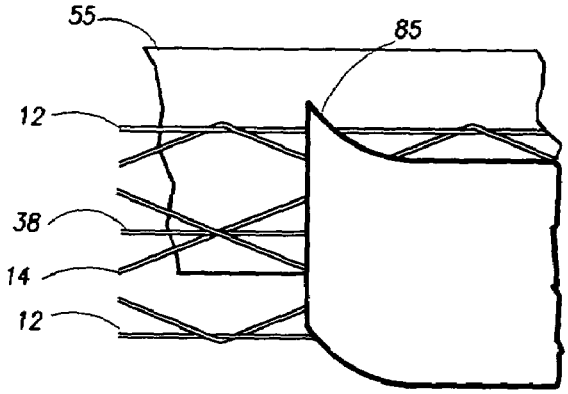
FIG. 11*a* is a top view of a fourth aspect of the third embodiment of the invention, a laminate having the first substrate offset from the second substrate and comprising a warp yarn made in accordance with the subject invention.

Referring to FIG. 11*a*, illustrated therein is a laminate 180*a*, a fifth aspect of the third embodiment of the invention. Laminate 180*a* is similar to laminate 180, in that it comprises all of the same elements, except that first substrate 55 and second substrate 85 are offset from each other.

Figure 11B:
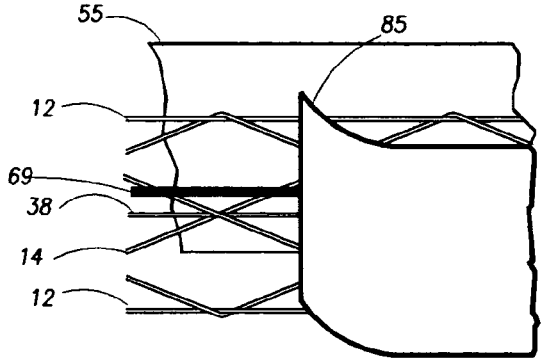
FIG. 11*b* is a top view of a fifth aspect of a third embodiment of the invention, a laminate having the first substrate offset from the second substrate and comprising a reinforcing wire and a warp yarn made in accordance with the subject invention.

Referring to FIG. 11*b*, illustrated therein is a laminate 180*b*, a sixth aspect of the third embodiment of the invention. Laminate 180*b* is similar to laminate 180*a*, except that it also comprises a reinforcing wire 69. Reinforcing wire 69 is incorporated into laminate 180*a* between the first substrate 55 and second substrate 85 adjacent to the reinforcing net 110 and adds structural strength and rigidity.

Figure 12:
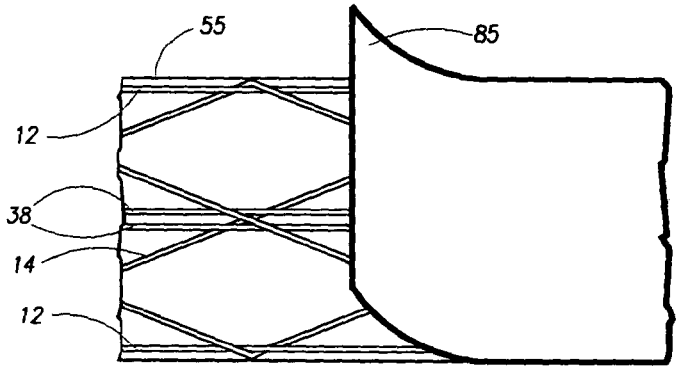
FIG. 12 is a top view of a sixth aspect of the third embodiment of the invention, a laminate which comprises two warp yarns made in accordance with the subject invention.

Referring to FIG. 12, illustrated therein is a laminate 280, a seventh aspect of the third embodiment of the invention. Laminate 280 may be used in a helical winding to make or reinforce a product and is a combination of first substrate 55, reinforcing net 210, second substrate 85 and adhesive.

Figure 12A:
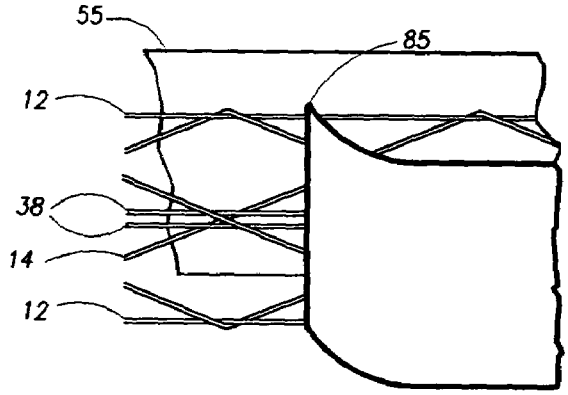
FIG. 12*a* is a top view of a seventh aspect of the third embodiment of the invention, a laminate having the first substrate offset from the second substrate and comprising two warp yarns made in accordance with the subject invention.

Referring to FIG. 12*a*, illustrated therein is a laminate 280*a*, an eighth aspect of the third embodiment of the invention. Laminate 280*a* is similar to laminate 280, in that it comprises all of the same elements, except that first substrate 55 and second substrate 85 are offset from each other.

Figure 12B:
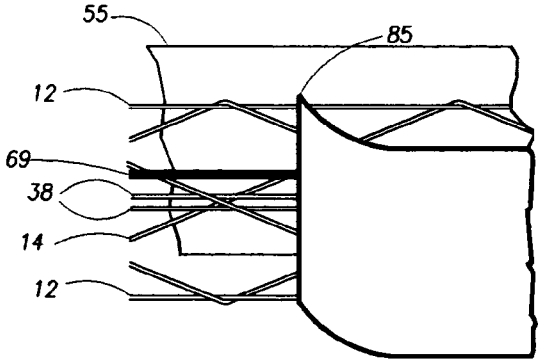
FIG. 12*b* is a top view of a eighth aspect of the third embodiment of the invention, a laminate having the first substrate offset from the second substrate and comprising a reinforcing wire and two warp yarns made in accordance with the subject invention.

Referring to FIG. 12*b*, illustrated therein is a laminate 280*b*, a ninth aspect of the third embodiment of the invention. Laminate 280*b* is similar to laminate 280*a*, except that it also comprises a reinforcing wire 69. Reinforcing wire 69 is incorporated into laminate 280*a* between the first substrate 55 and second substrate 85 adjacent to the reinforcing net 210 and adds structural strength and rigidity.

Figure 13:
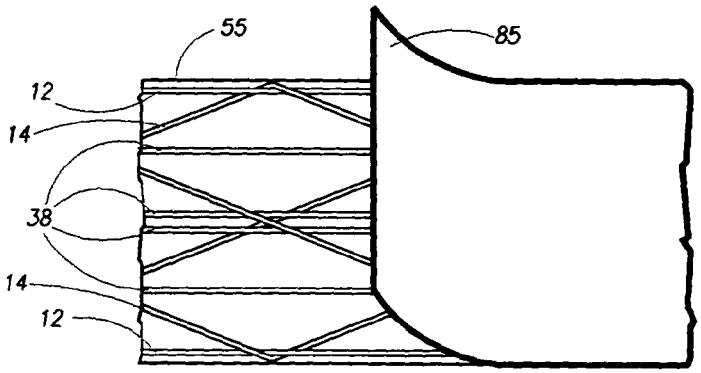
FIG. 13 is a top view of a ninth aspect of the third embodiment of the invention, a laminate comprising four warp yarns made in accordance with the subject invention.
Figure 13A:
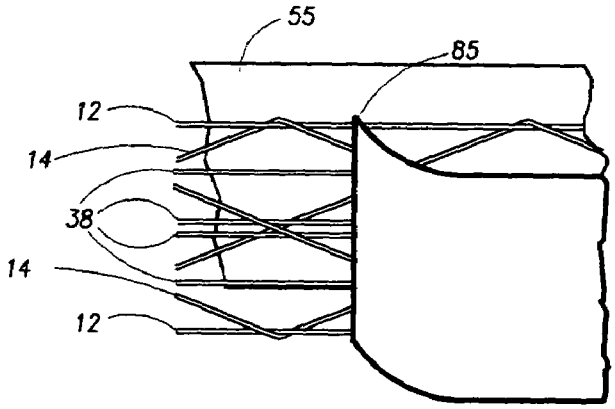
FIG. 13*a* is a top view of a tenth aspect of the third embodiment of the invention, a laminate having the first substrate offset from the second substrate and comprising four warp yarns made in accordance with the subject invention.

Referring to FIG. 13, illustrated therein is a laminate 380, an eleventh aspect of the third embodiment of the invention. Laminate 380 may be used in a helical winding to make or reinforce a product and is a combination of a substrate 55, reinforcing net 310, second substrate 85 and adhesive Referring to FIG. 13*a*, illustrated therein is a laminate 380*a*, a second aspect of the third embodiment of the invention. Laminate 380*a* is similar to laminate 380, in that it comprises all of the same elements, except that first substrate 55 and second substrate 85 are offset.

Figure 13B:
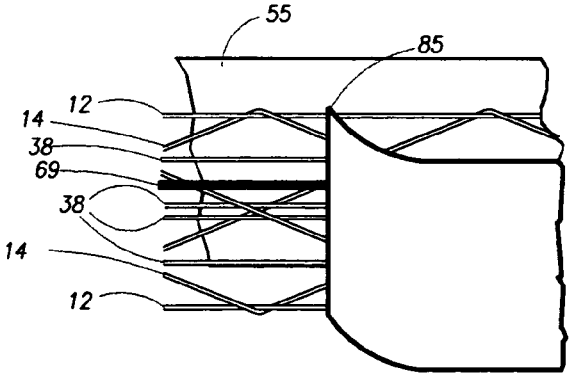
FIG. 13*b* is a top view of an eleventh of the third embodiment of the invention, a laminate having the first substrate offset from the second substrate and comprising a reinforcing wire and four warp yarns made in accordance with the subject invention.

Referring to FIG. 13*b*, illustrated therein is a laminate 380*b*, a twelfth aspect of the third embodiment of the invention. Laminate 380*b* is similar to laminate 380*a*, except that it also comprises a reinforcing wire 69. Reinforcing wire 69 is incorporated into laminate 380*a* between the first substrate 55 and second substrate 85 adjacent to the reinforcing net 310 and adds structural strength and rigidity.

Figure 14:
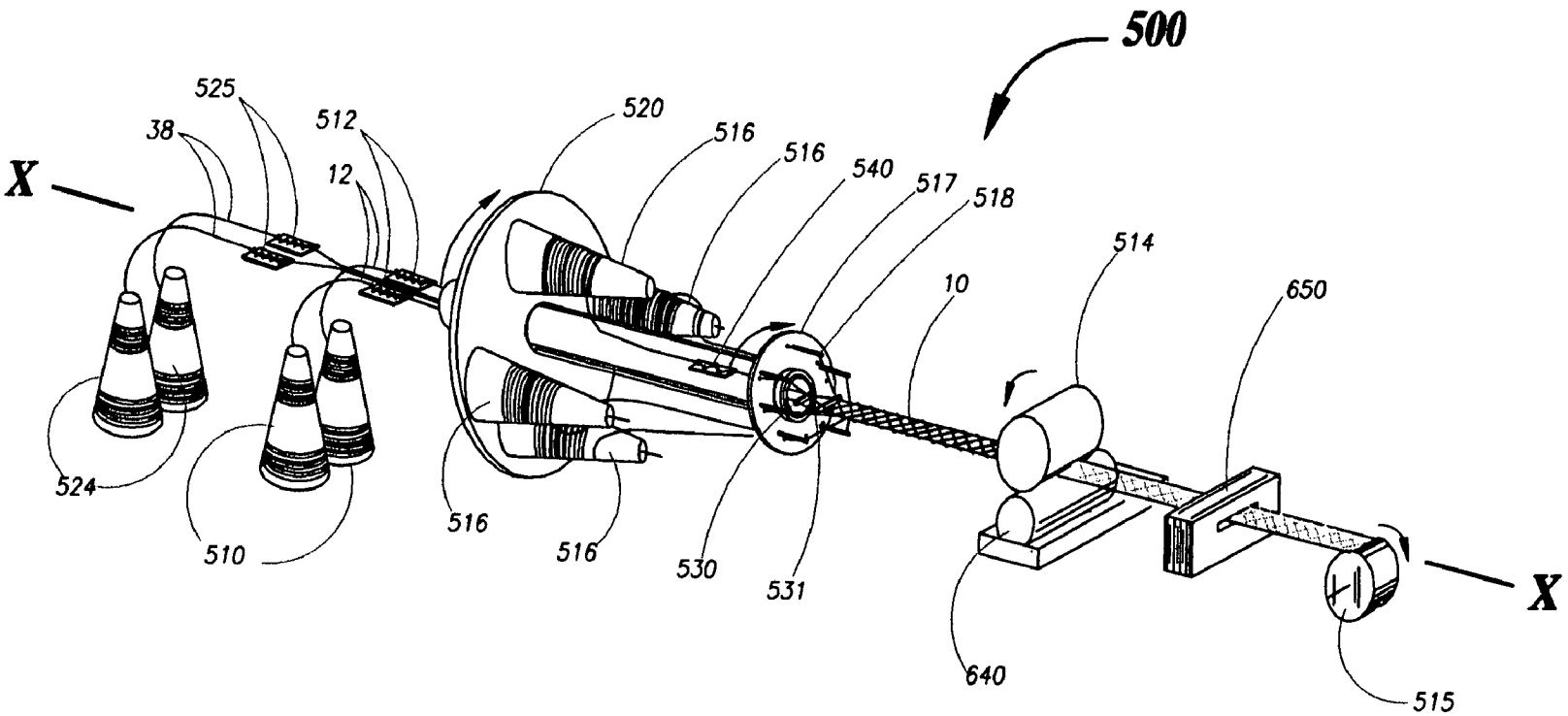
FIG. 14 is a perspective view of an apparatus for forming a reinforcing net in accordance with the invention.

Referring to FIG. 14, an apparatus 500 for manufacturing the reinforcing net 10 is illustrated. Apparatus 500 comprises two spreader spools 510, warp spools 524, a spreader yarn tension device 512, a warp yarn tension device 525, weft spools 516, a mounting plate 520, weft yarn tensioning device 540, weft yarn guide 517, a first spreader yarn guide 530, a second spreader yarn guide 531 (see FIG. 17), nip rolls 514, coating roll device 640, drying oven device 650, and spooler 515. FIG. 14 is a simplified illustration of the apparatus. Not shown in FIG. 14 are the overall frame and structure of the apparatus, the drive motors, etc.

Spreader spools 510 provide spreader yarns 12. The spreader spools 510 are stationarily attached to the frame of the apparatus 500. Tension device 512 in conjunction with nip rolls 514 and the spooler 515 create tension in the spreader yarns 12 in the portion between the tension device 512 and the nip rolls 514. Tension device 512 adds a frictional drag to the spreader yarns 12. The spreader yarns 12, supplied by spreader spools 510 are pulled past tension device 512 along longitudinal axis X. This advancement can be caused by the nip rolls 514, the spooler 515 or both the nip rolls 514 and the spooler 515. The tension created in the spreader yarns 12 will preferably be of a sufficient magnitude to prevent the spreader yarns 12 from being moved towards each other when one or more weft yarns 14 is wrapped around the spreader yarns 12.

Spreader yarns 12 are positioned a pre-determined parallel distance apart by the first spreader yarn guide 530 and the second spreader yarns guide 531.

Weft yarns 14 will be wrapped around the advancing spreader yarns 12. Weft spools 516 supply weft yarn 14. These weft spools 516 are mounted on a mounting plate 520, which revolves around the longitudinal axis X. The revolving of the mounting plate 520 and the weft spools 516 supplying weft yarn 14, causes the weft yarns 14 to wrap around the spreader yarns 12. The weft spools 516 will have to be distanced far enough away from axis X so that the weft spools 516 will not interfere with the spreader yarns 12 when the mounting plate 520 revolves.

The weft yarn guide 517 also revolves around longitudinal axis X at the same velocity and in the same direction as mounting plate 520 and will comprise a plurality of holes 518. Weft yarns 14 supplied by weft spools 516 pass through weft yarn tensioning devices 540. Ideally, each weft yarn 14 should have a corresponding weft yarn tensioning device 540. Weft yarn tensioning device 540 adds a frictional drag to the weft yarns 14.

As shown, after the weft yarns 14 pass through the weft yarn tensioning device 540, the weft yarns 14 pass through the plurality of holes 518. Optionally, the yarn tensioning devices 540 may be downstream of holes 518. Ideally, each of the plurality of holes 518 should have a corresponding weft spool 516. The plurality of holes 518 will also have to be a sufficient distance from the longitudinal axis X so that it does not interfere with the spreader yarns 12 when the weft guide 517 revolves. The mounting plate 520 and the weft yarn guide 517 each have a central aperture so that the spreader yarns 12 and any warp yarns 38 may pass therethrough without being affected by the rotation of the mounting plate 520 and the weft guide 517.

The movement of the weft spools 516 mounted to the mounting plate 520 and the revolving of the weft yarn guide 517 around spreader yarns 12 will form the reinforcing net 10. The movement of the weft spools 516 and the weft yarn guide 517, causes the weft yarn 14 to wrap around the spreader yarns 12 and the advancement of the spreader yarns 12 by nip rolls 514 will cause the weft yarns 14 to extend at an angle from the spreader yarns 12. The weft spools 516 and the weft yarn guide 517 revolving, in conjunction with the advancement of the spreader yarns 12 by the nip rolls 514, causes the weft yarns 14 to extend from the spreader yarns 12, across one side of the longitudinal plane formed by the spreader yarns to one of the spreader yarns 12, wrap around the spreader yarn 12 and extend across the plane on the other side of the plane and back to the other spreader yarn 12 and around the other spreader yarn 12. The continuous rotation of the weft spools 516 and the weft yarn guide 517 can create a continuous reinforcing net 10. Preferably, the speed of rotation of the mounting plate 520 and weft guide 517 is co-related to the rate of advance of the spreader yarns so that the angle of the weft yarns to the spreader yarns is about 45° to gain the most efficient strength of the net although any desired angle may be used.

The net includes adhesive so the yarns are bonded to each other at a plurality of intersections. Adhesive may be applied to the spreader yarns 12. The adhesive could be applied to the reinforcing net 10 in numerous ways. It could be applied to spreader yarns 12 after they are supplied by spreader spools 510, at tension device 512, when the spreader yarns 12 are in tension after passing tension device 512 or when the reinforcing net 10 comes in contact with nip rolls 514. FIG. 14 shows the application of adhesive using coating roll device 640. Coating roll device 640 coats nip rolls 514 with adhesive, so that adhesive is applied to reinforcing net 10 when it passes through nip rolls 514.

After passing through nip rolls 514, reinforcing net 10 is passed through drying oven device 650, to dry the adhesive, and collected on spooler 515. Alternatively, reinforcing net 10 could be immediately used to form a helically wound product.

Apparatus 500 could also be used to form reinforcing nets 110, 210 and 310. Warp yarn spools 524 supply the desired number of warp yarns 38 and are located near the spreader spools 510 on the frame of apparatus 500. The warp yarns 38 are placed under tension by warp yarn tension device 525. The warp yarns 38 are located in between spreader yarns 12 and are advanced by nip rolls 514 and the spooler 515. The first spreader yarn guide 530 and the second spreader yarn guide 531 position the warp yarns 38 a pre-determined, parallel distance apart.

Figure 14A:
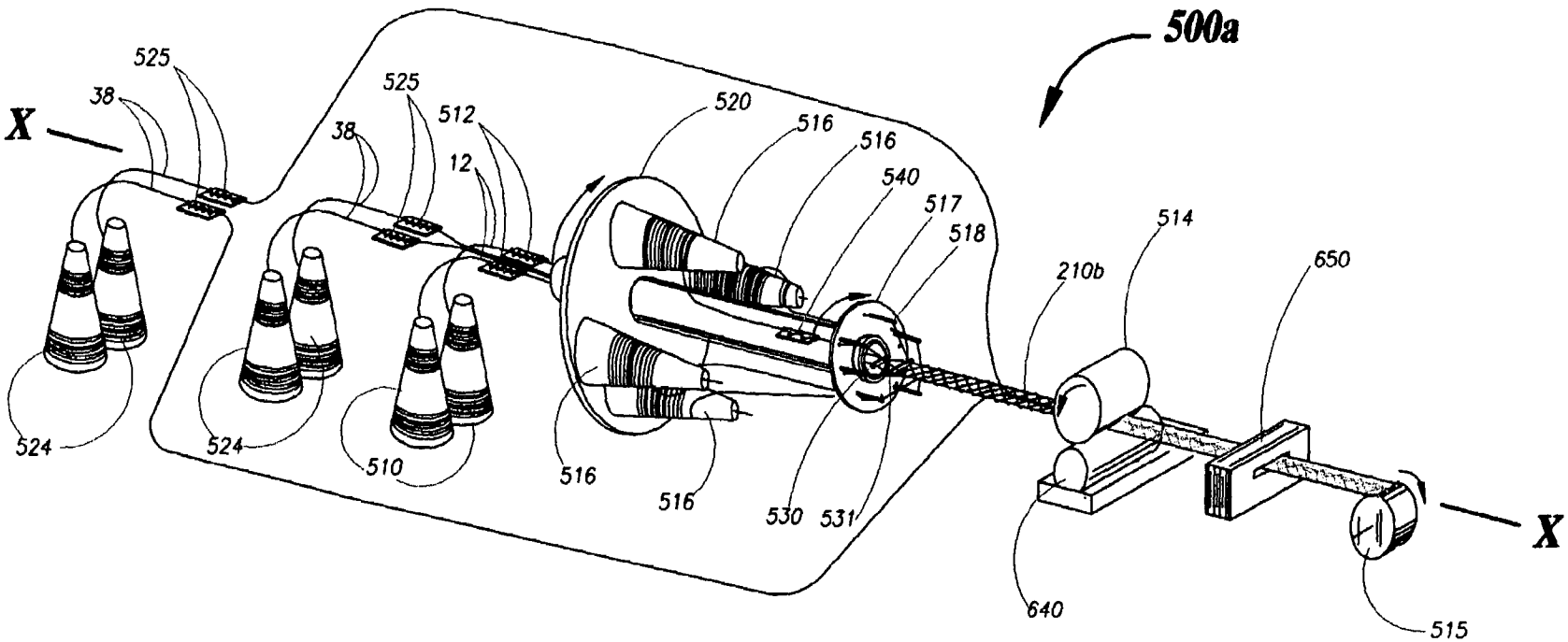
FIG. 14*a* is a perspective view of an apparatus for forming a reinforcing net with warp yarns located adjacent to the weft yarns in accordance with the invention.

Referring now to FIG. 14*a*, apparatus 500*a* for manufacturing a reinforcing net 210*b* is illustrated. Apparatus 500*a* is similar to apparatus 500, in that it incorporates many of the same elements. Additionally, warp yarns 38 are placed adjacent to the weft yarns 14 after the weft yarns 14 are wrapped around the spreader yarns 12 forming reinforcing net 210*b*. By varying the number of warp yarn spools 524 and the sides of the plane the warp yarns 38 are placed adjacent to, reinforcing nets 110*a*, 210*a*, 310*a* and 310*b* can also be made.

Figure 15:
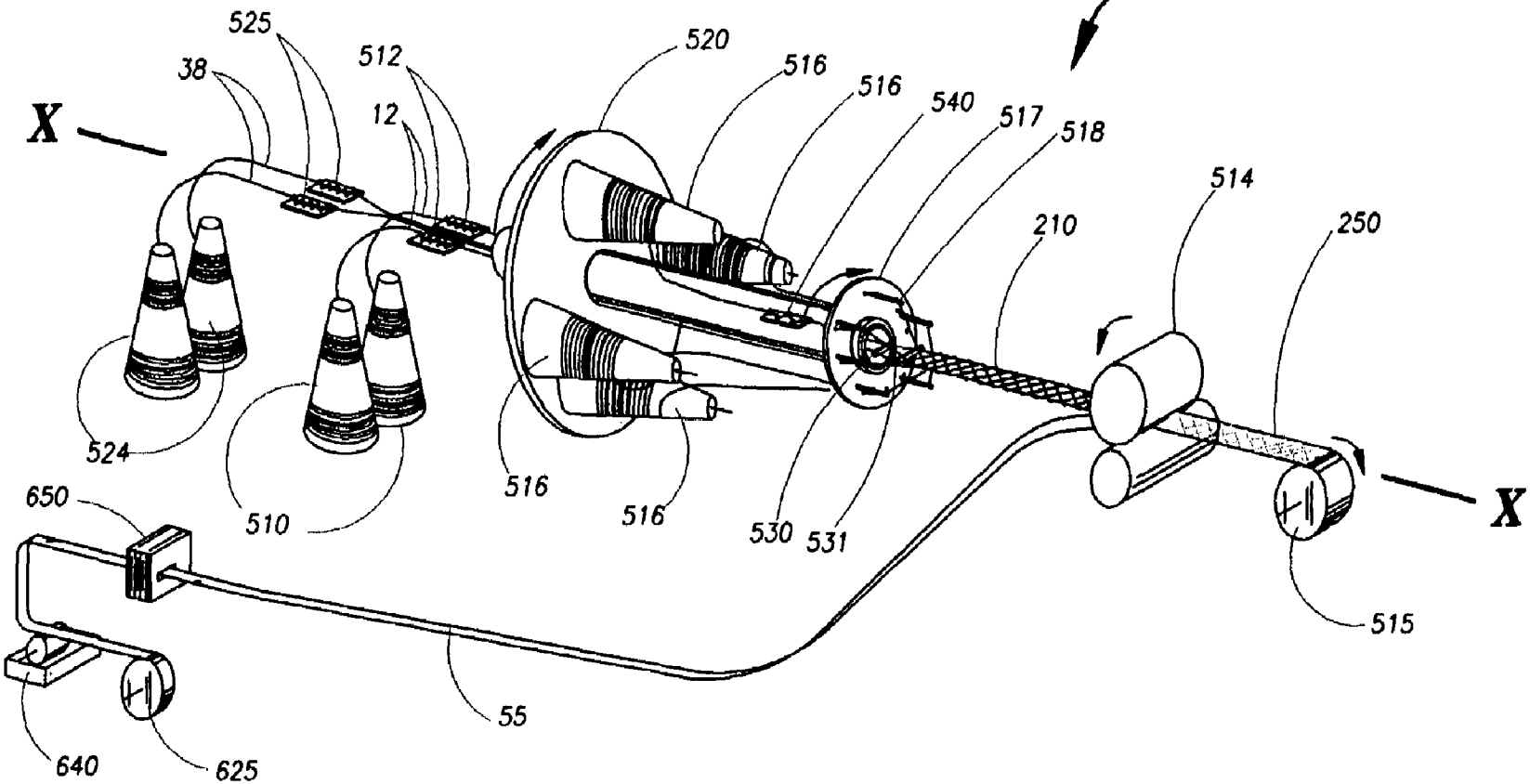
FIG. 15 is a perspective view of an apparatus for forming a ribbon in accordance with the invention.

Referring now to FIG. 15, apparatus 600 for manufacturing a ribbon 250 is illustrated. Apparatus 600 incorporates the elements present in apparatus 500 (similar or common elements will be referenced using the same numbers) and further comprises a first substrate supply 625 that supplies first substrate 55. FIG. 15 is a simplified illustration of the apparatus. Not shown in FIG. 15 are the overall frame and structure of the apparatus, the drive motor, all of the necessary guides for first substrate 55, etc.

Reinforcing net 210 is formed in the same manner as described in relation to apparatus 500. Additionally a first substrate supply 625 supplies first substrate 55. First substrate 55 is coated with adhesive by coating device 640 and is passed through drying oven device 650. The apparatus 600 causes the first substrate 55 to be provided contiguous with reinforcing net 210 and both the first substrate 55 and reinforcing net 210 are passed through nip rolls 514. As the first substrate 55 and reinforcing net 210 pass through nip rolls 514, the pressure exerted on the first substrate 55 and reinforcing net 210 by nip rolls 514 causes the adhesive coated on substrate 55 to affix to reinforcing net 210 forming ribbon 250.

Apparatus 600 could also be used to form ribbons 50, 150 or 350. Similar to apparatus 500, apparatus 600 can also form reinforcing nets 10, 110 and 310 by varying the number of warp yarn spools. Then by placing first substrate 55 adjacent to reinforcing net 10, 110 or 310, and passing the combined structure through nip rolls 514, ribbon 50, 150, or 350 can be formed.

Figure 15A:
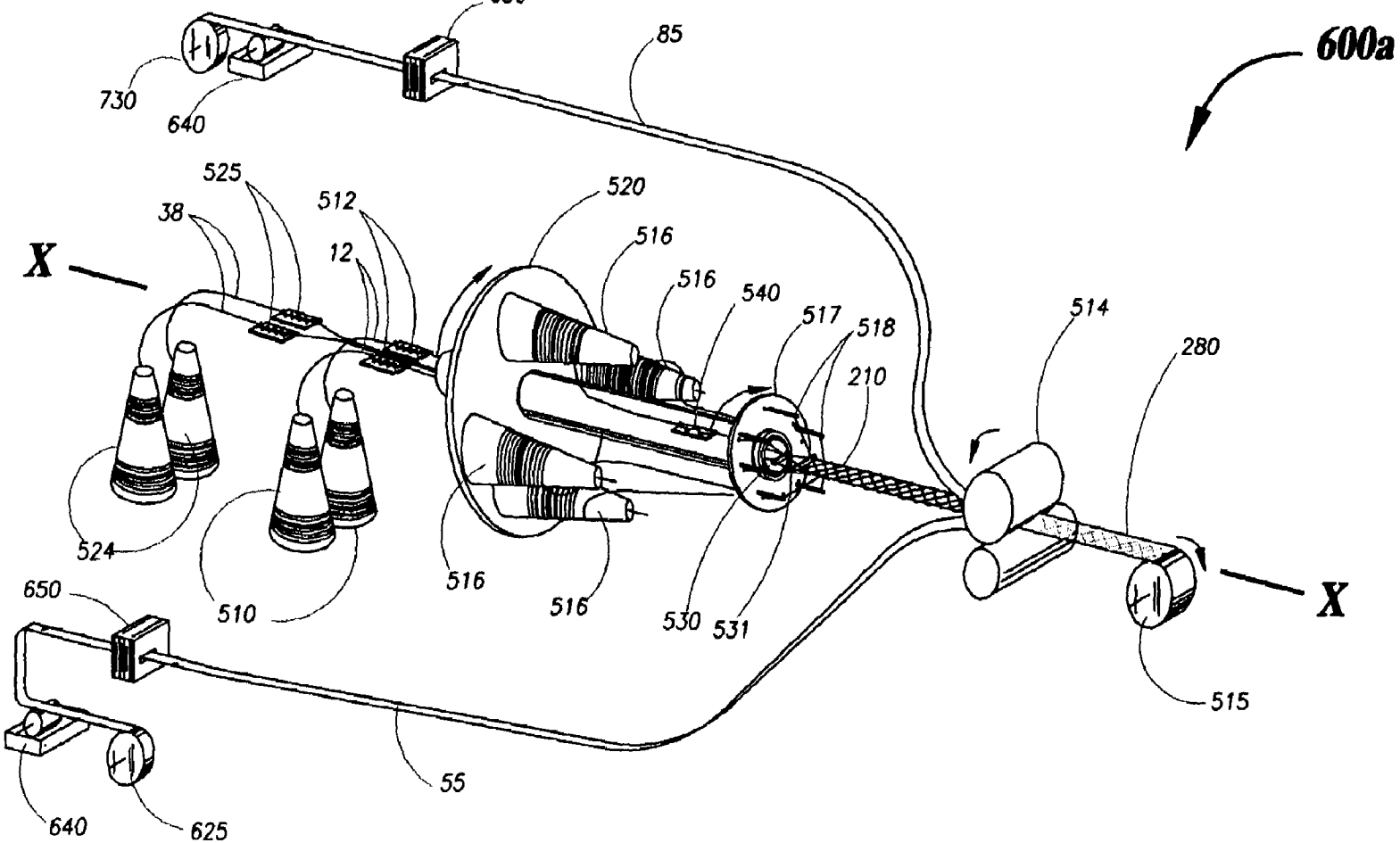
FIG. 15*a* is a perspective view of an apparatus for forming a laminate in accordance with the invention.

Referring now to FIG. 15*a*, an apparatus 600*a* for manufacturing a laminate 280 is illustrated. Apparatus 600*a* incorporates the elements present in apparatus 600 (similar or common elements will be referenced using the same numbers) and further comprises a second substrate roll 730 that supplies second substrate 85. FIG. 15*a* is a simplified illustration of the apparatus that does not show all of the necessary elements. Not shown in FIG. 15*a* are the overall frame and structure of the apparatus, the drive motor, all of the necessary guides for first substrate 55 and second substrate 85, etc.

Reinforcing net 210 is formed in the same manner as described in relation to apparatus 600. Additionally, the second substrate supply 730 supplies second substrate 85. Second substrate 85 is coated with adhesive by coating device 640 and is passed through drying oven 650. First substrate 55 and second substrate 85 are located next to reinforcing net 210 immediately before the nip rolls 514. These three elements are then passed through nip rolls 514, which causes the adhesive to bond the elements together to form laminate 280.

Apparatus 600*a* can also be used to form laminates 80, 180, 280 and 380. Similar to apparatus 500, apparatus 600*a* can also form reinforcing nets 10, 110 and 310. Then by placing first substrate 55 and second substrate 85 so that they sandwich the reinforcing net 10, 110 or 310 and passing the combined structure through nip rolls 514, laminate 80, 180, 280 or 380 can be formed.

Apparatus 600*a* can also be used to form laminate 80*a*, 180*a*, 280*a* or 380*a* by placing first substrate 55 and second substrate 85 offset against each other and sandwiching the reinforcing net 10, 110 or 310.

Figure 15B:
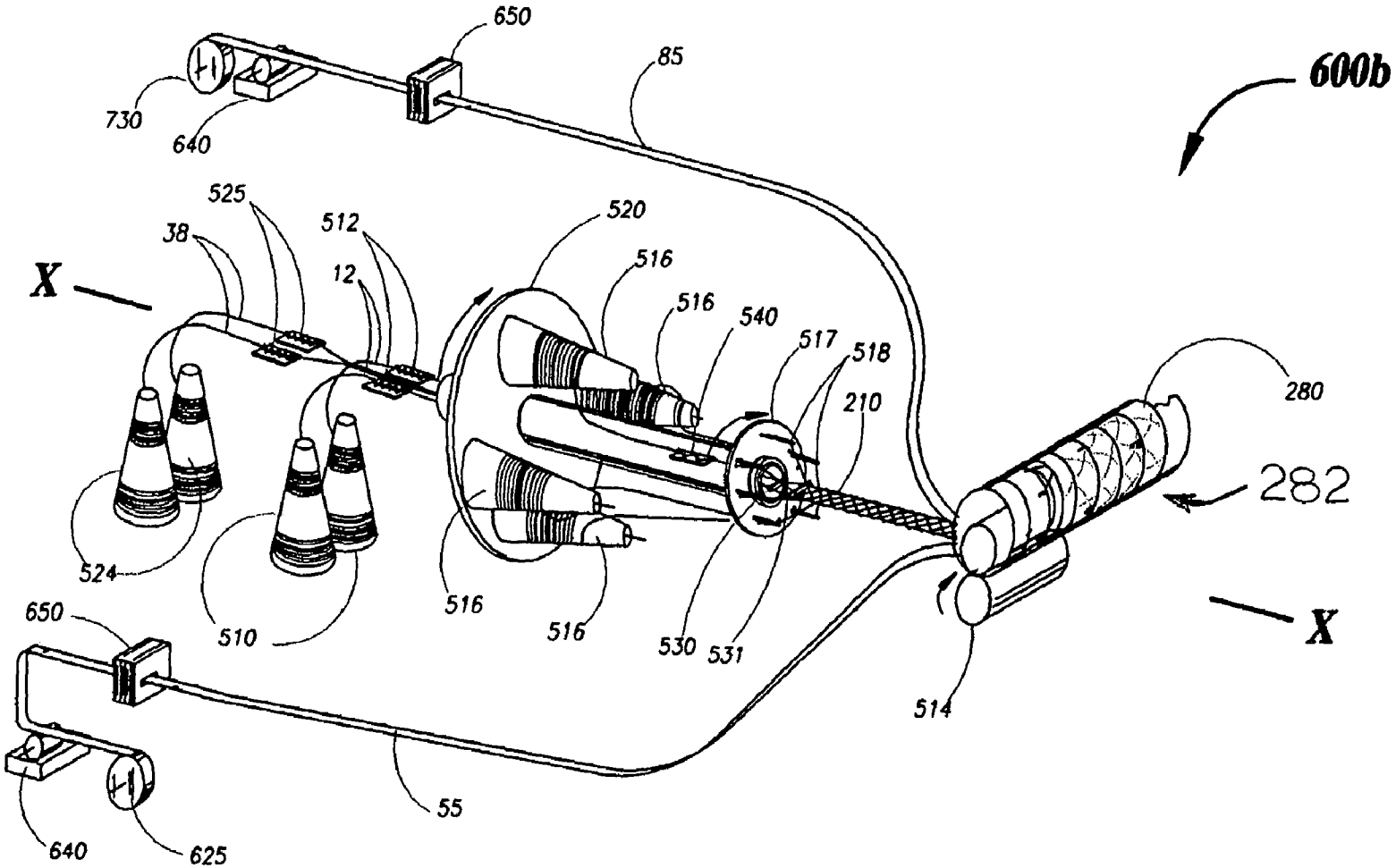
FIG. 15*b* is a perspective view of an apparatus for forming a laminate and making the laminate into a helically wound product in accordance with the invention.

Referring now to FIG. 15*b*, an apparatus 600*b* for manufacturing a laminate 280, which is then used to from a helically wound product 282, is illustrated. Apparatus 600*b* incorporates the elements present in apparatus 600*a* (similar or common elements will be referenced using the same numbers), however, nip rolls 514 are used to form a helically wound product 282 from laminate 280. FIG. 15*b* is a simplified illustration of the apparatus that does not show all of the necessary elements. Not shown in FIG. 15*b* are the overall frame and structure of the apparatus, the drive motor, all of the necessary guides for first substrate 55 and second substrate 85, etc. Apparatus 600*b* can also be used to form laminate 80*a*, 180*a*, 280*a* or 380*a* by placing first substrate 55 and second substrate 85 so that they sandwich the reinforcing net 10, 110, 210 or 310, which may then be used to form a respective helically wound product.

Figure 15C:
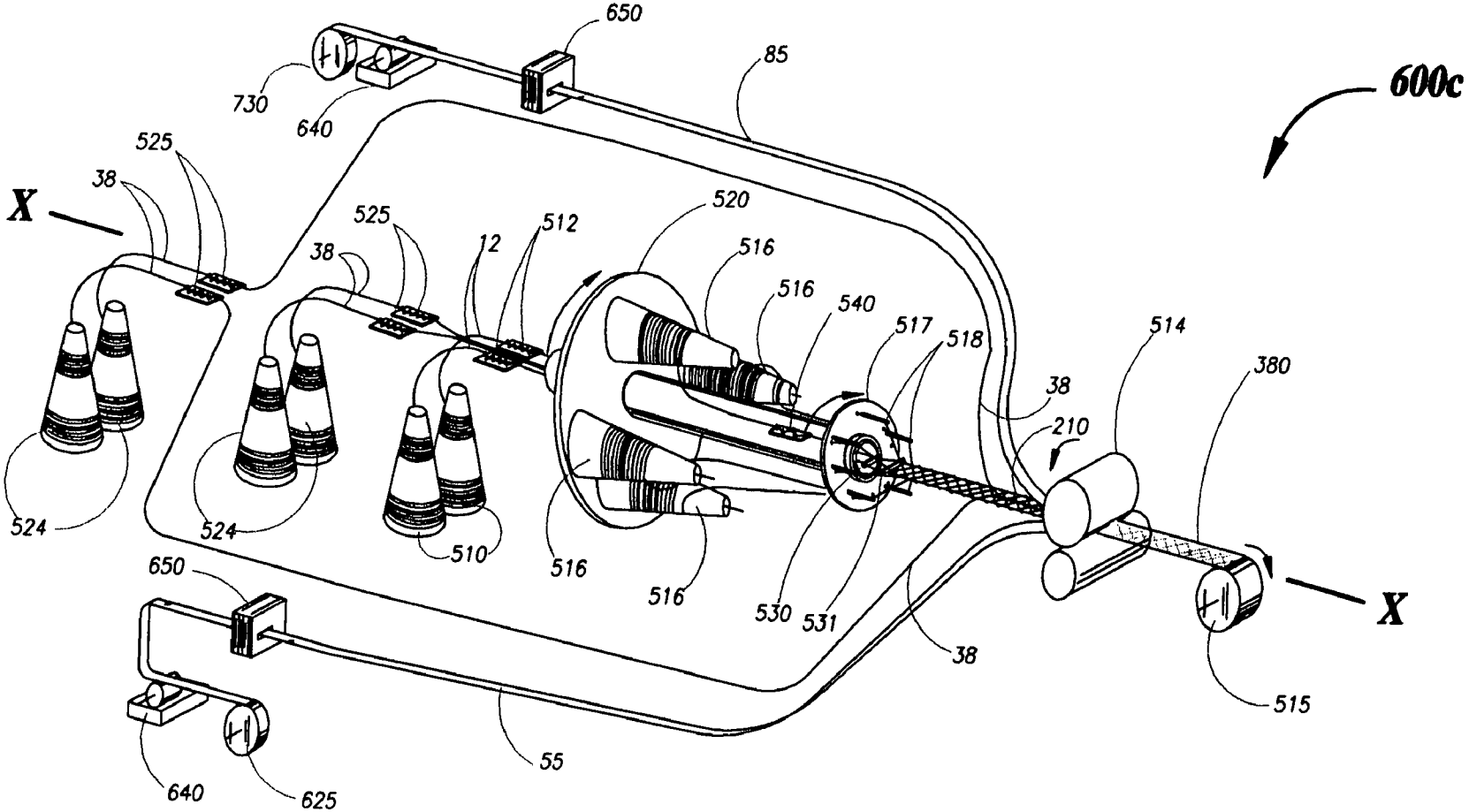
FIG. 15*c* is a perspective view of an apparatus for forming a laminate comprising warp yarns located adjacent to the weft yarns in accordance with the invention.

Referring now to FIG. 15*c*, apparatus 600*c* for manufacturing a laminate 380 is illustrated. Apparatus 600*c* is similar to apparatus 600*a*, in that is incorporates many of the same elements. Additionally, warp yarns 38 are placed adjacent to the weft yarns 14 after the weft yarns 14 are wrapped around the spreader yarns 12 and all three elements are passed through nip rolls 514 forming laminate 380. Laminate 380 is then collected on spooler 515. Apparatus 600*c* can also be used to form laminate 380*a* by placing first substrate 55 and second substrate 85 so that they sandwich the reinforcing net 310. Laminate 380*a* is then collected on spooler 515.

Figure 15D:
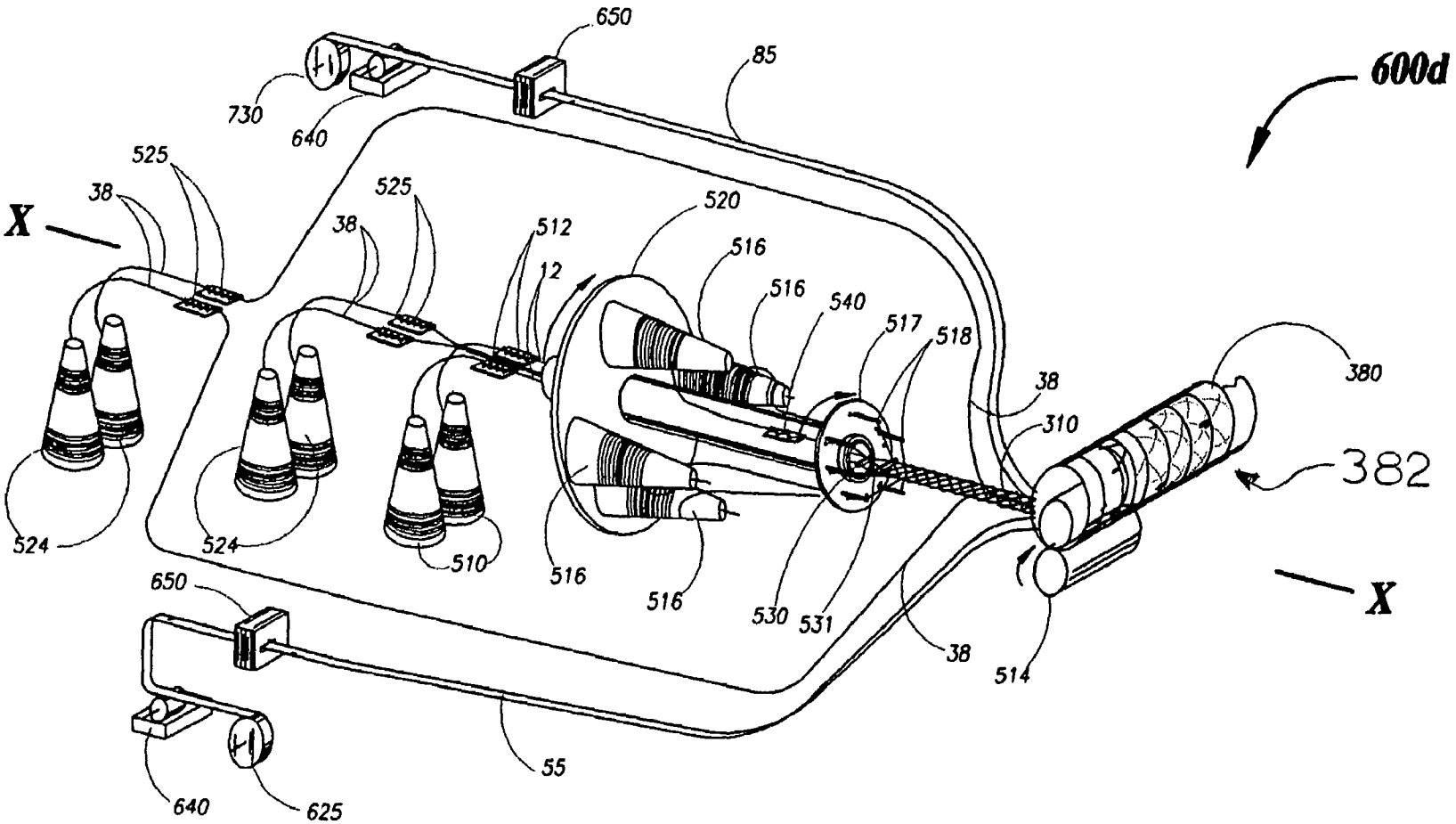
FIG. 15*d* is a perspective view of an apparatus for forming a laminate comprising warp yarns located adjacent to the weft yarns and making the laminate into a helically wound product in accordance with the invention.

Referring now to FIG 15*d*, apparatus 600*d* for manufacturing a laminate 380, and then forming a helically wound product 382 with laminate 380, is illustrated. Apparatus 600*d* incorporates the elements present in apparatus 600*c* (similar or common elements will be referenced using the same numbers), however, nip rolls 514 are used to form a helically wound product 382 from laminate 380. FIG. 15*d* is a simplified illustration of the apparatus that does not show all of the necessary elements. Not shown in FIG. 15*d* are the overall frame and structure of the apparatus, the drive motor, all of the necessary guides for first substrate 55 and the second substrate 85, etc. Apparatus 600*d* can also be used to form laminate 80*a*, 180*a*, 280*a* or 380*a* by placing the first substrate 55 and second substrate 85 so that they sandwich the reinforcing net 10, 110, 210 or 310, which may then be used to form a respective helically wound product.

Figure 16:
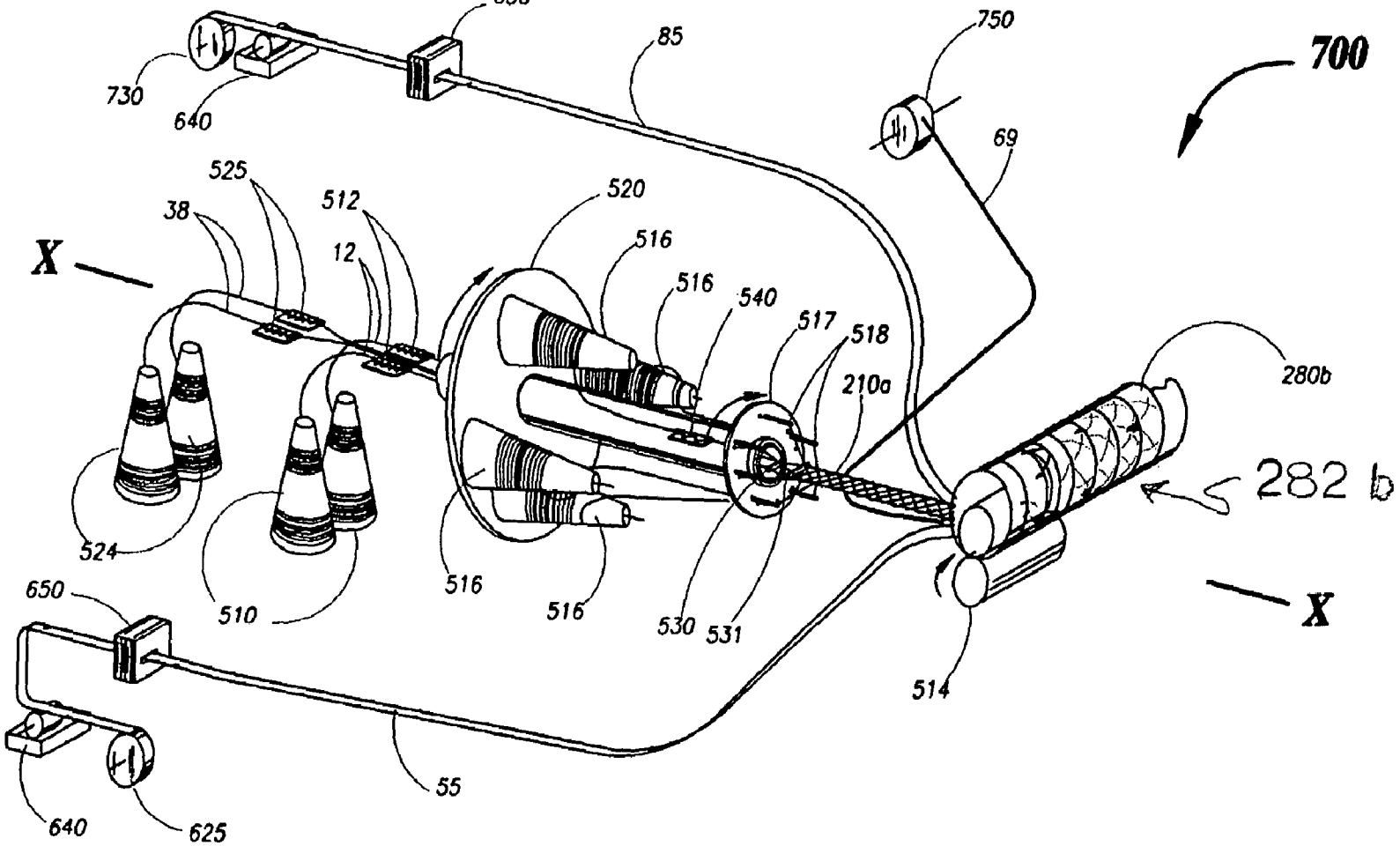
FIG. 16 is a perspective view of an apparatus for forming a laminate comprising a reinforcing wire in accordance with the invention.

Referring now to FIG. 16, an apparatus 700 for manufacturing a laminate 280*b*, comprising a reinforcing wire 69, and then forming a helically wound product 282*b* is illustrated. Apparatus 700 incorporates the elements present in apparatus 600*a* (similar or common elements will be referenced using the same numbers) and further comprises a reinforcing wire supply 750 that supplies reinforcing wire 69. FIG. 16 is a simplified illustration of the apparatus that does not show all of the necessary elements. Not shown in FIG. 16 are the overall frame and structure of the apparatus, the drive motor, all of the necessary guides for first substrate 55, second substrate 85, reinforcing wire 69, etc.

Reinforcing wire supply 750 is provided to supply reinforcing wire 69. Reinforcing wire 69 is placed at any desirable location adjacent to reinforcing net 210*a* and between first substrate 55 and second substrate 85 immediately before the nip rolls 514. These four elements are then passed through nip rolls 514, which causes the adhesive to bond the elements together to form laminate 280*b*.

Apparatus 700 can also be used to form laminate 80*b*, 180*b*, 280*b* or 380*b* by varying the number of warp yarns 38 and warp yarn spools 524.

Figure 16A:
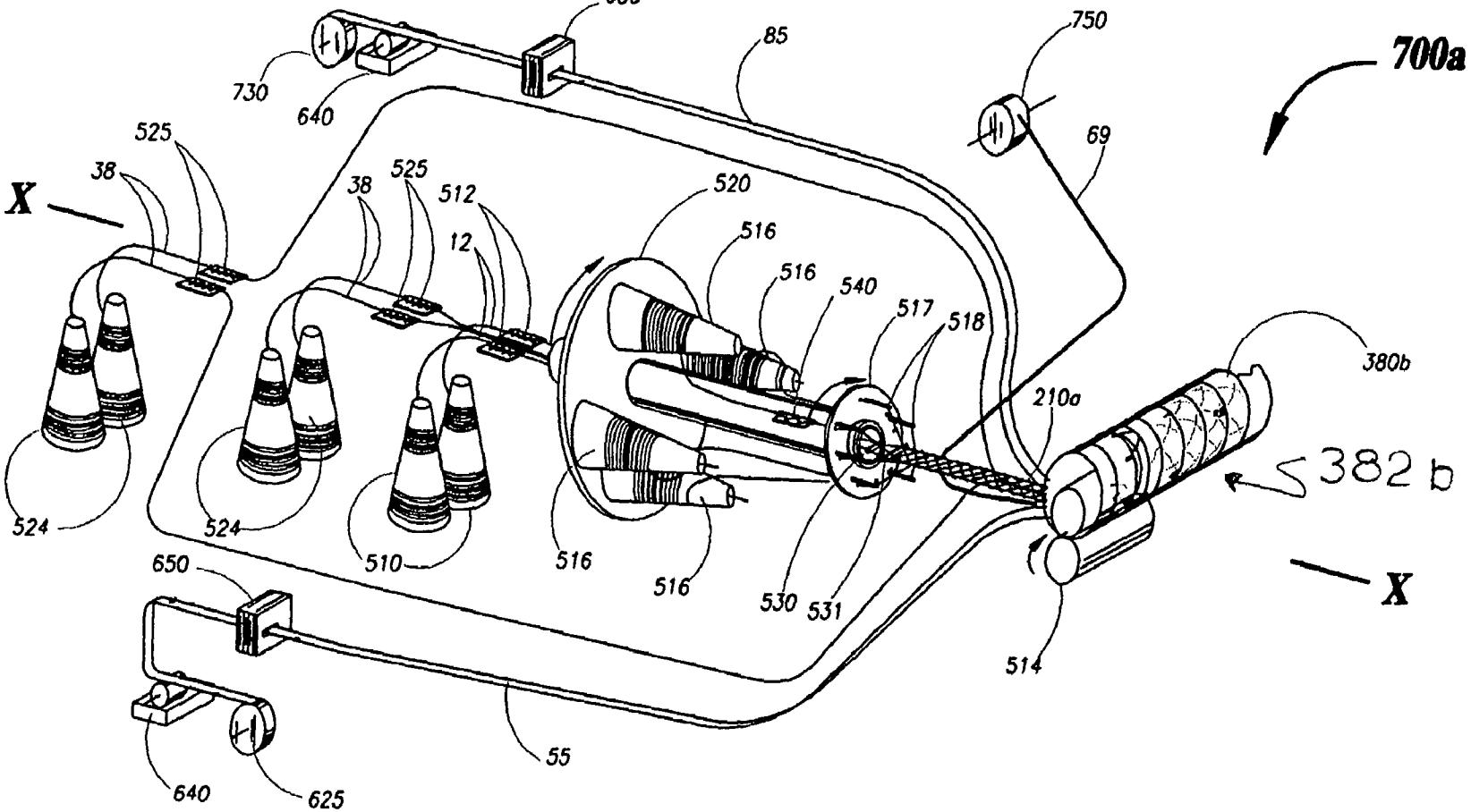
FIG. 16*a* is a perspective view of an apparatus for forming a laminate comprising warp yarns located adjacent to the weft yarns and a reinforcing wire, and making the laminate into a helically wound product in accordance with the invention.

Referring now to FIG. 16*a*, apparatus 700*a* for manufacturing a laminate using reinforcing net 210*a* is illustrated. Apparatus 700*a* is similar to apparatus 700, in that it incorporates many of the same elements. Additionally, warp yarns 38 are placed adjacent to the weft yarns 14 after the weft yarns 14 are wrapped around the spreader yarns 12 forming a laminate with reinforcing net 210*a*, forming a laminate 380*b* and then forming a helically wound product 382*b*.

Figure 17:
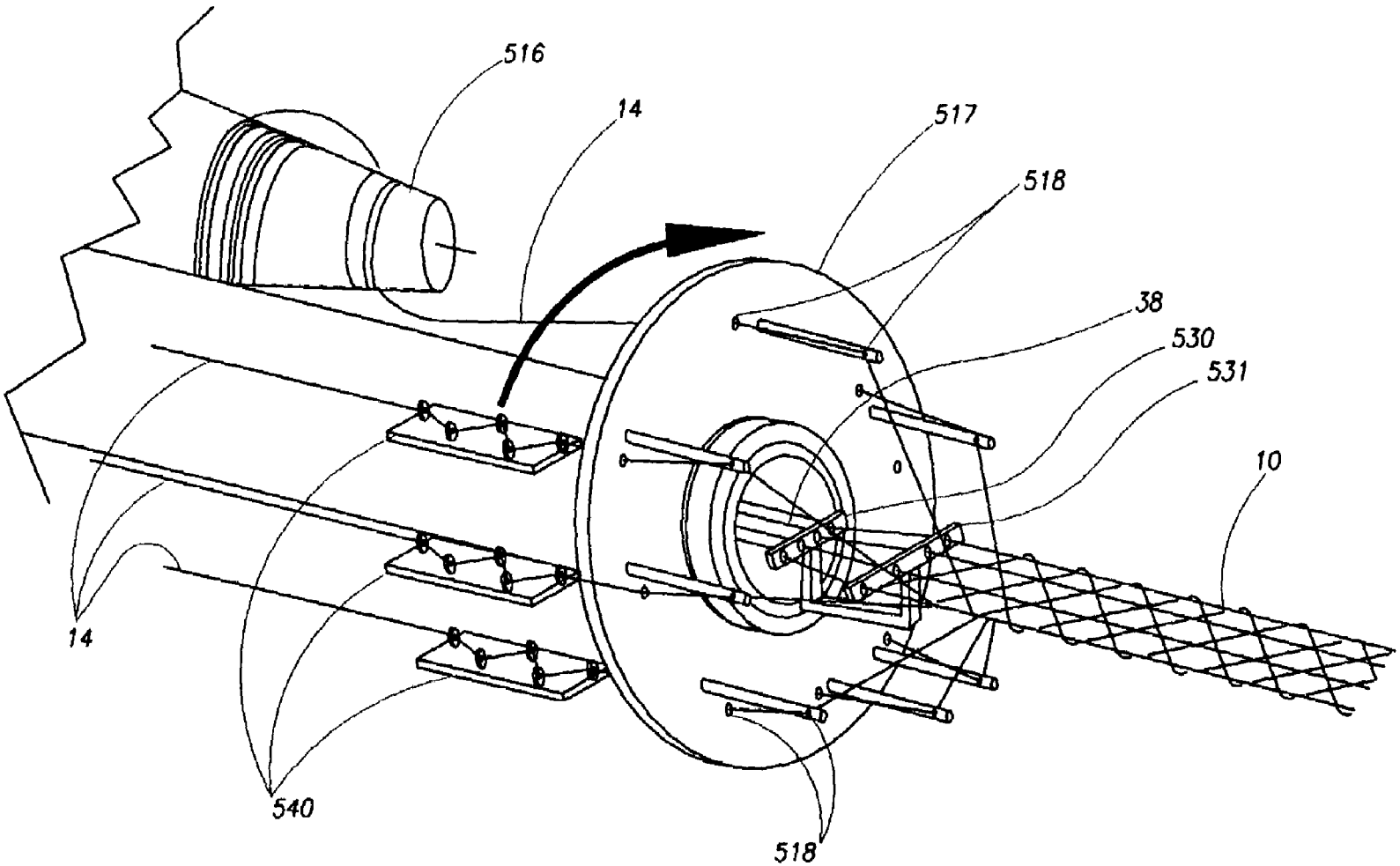
FIG. 17 is a close up view of a portion of the apparatus of FIG. 14.

Referring now to FIG. 17, a close-up view of the first spread yarn guide 530 and the second spreader yarn guide 531 is shown.

It is to be understood that what has been described are various embodiments and aspects of the invention. The invention nonetheless is susceptible to certain changes and alternative embodiments fully comprehended by the spirit of the invention as described above, and the scope of the claims set out below. For example, the yarns may be made from different materials. The number and lateral location of the warp yarns may be varied as desired. The number and angular orientation of the weft yarns may be varied. The warp yarns may be either adjacent or between the weft yarns or any combination of adjacent or between may be used. The substrates whether one or two or more may be from any desirable material. The substrates may have any desired lateral width and relative location, with or without offsets, on one or both lateral edges. One or more other strengthening wires of various materials such as metal, wire or plastic wire may also be used.

The invention claimed is:

1. A helically wound conduit, said conduit having a helically wound wall, said wall comprising; a ribbon, the ribbon comprising: at least one substrate having a substrate width and a longitudinal axis: an adhesive on said substrate; and a non-woven, non-knitted reinforcing net, said reinforcing net comprising, at least two separated, substantially parallel continuous longitudinally extending spreader yarns, said spreader yarns defining a longitudinally extending plane; having a spreader width and said substrate width is slightly larger than said spreader width and said spreader yarns extend longitudinally adjacent the edges of said substrate, a plurality of continuous weft yarns extending at an angle to said spreader yarns and extending across one side of said plane around one of said spreader yarns and across said plane on the other side of said plane to the other spreader yarn and around said other spreader yarn;

and wherein said reinforcing net is affixed to said substrate, and wherein said ribbon is wound with its longitudinal axis following a helix to form said helically wound wall, said helically wound wall constituting the inner surface of said conduit.

2. A conduit as claimed in claim 1 wherein said reinforcing net includes at least one warp yarn.

3. A conduit as claimed in claim 2 wherein said reinforcing net includes a plurality of warp yarns.

4. A conduit as claimed in claim 3 wherein said warp yarns are substantially parallel to said spreader yarns.

5. A conduit as claimed in claim 1 wherein said plurality of weft yarns extend at an angle substantially 45° to said spreader yarns.

6. A conduit as claimed in claim 1 wherein said weft yarns extend at an angle of at least 45° to the spreader yarns.

7. A conduit as claimed in claim 3 wherein a plurality of said warp yarns are located between said weft yarns.

8. The conduit as claimed in claim 3 wherein a plurality of said warp yarns are located adjacent said weft yarns.

9. The conduit of claim 7 wherein a plurality of said warp yarns are located adjacent said weft yarns.

10. A conduit as claimed in claim 1 wherein said reinforcing net is affixed to said substrate so that said longitudinal axis of said substrate is in substantially the same direction as said longitudinally extending plane of said spreader yarns.

11. A conduit as claimed in claim 1 having at least one second substrate.

12. A conduit as claimed in claim 11 wherein said reinforcing net is affixed between said first substrate and said second substrate to form a laminate.

13. A conduit as claimed in claim 12, said laminate further comprising a reinforcing wire affixed between said first substrate and said second substrate.

14. The conduit as claimed in claim 12 wherein said reinforcing net includes at least one warp yarn.

15. The conduit as claimed in claim 14 wherein said reinforcing net includes a plurality of warp yarns.

16. The conduit as claimed in claim 15 wherein said warp yarns are substantially parallel to said spreader yarns.

17. The conduit as claimed in claim 12 wherein said plurality of weft yarns extend at an angle substantially 45° to said spreader yarns.

18. The conduit as claimed in claim 12 wherein said weft yarns extend at an angle of at least 45° to the spreader yarns.

19. The conduit as claimed in claim 15 wherein said warp yarns are located between said weft yarns.

20. The conduit as claimed in claim 15 wherein a plurality of said warp yarns are located adjacent said weft yarns.

21. The conduit as claimed in claim 9 wherein a plurality of said warp yarns are located adjacent said weft yarns.

22. The conduit as claimed in claim 12 wherein said first substrate is laterally offset from said second substrate.

* * * * *